US010085554B2

(12) United States Patent
Schooley, Jr. et al.

(10) Patent No.: US 10,085,554 B2
(45) Date of Patent: Oct. 2, 2018

(54) GUN CABINET

(71) Applicant: Robert A. Schooley, Jr., Raleigh, NC (US)

(72) Inventors: Robert A. Schooley, Jr., Raleigh, NC (US); Rex Gabriel Carriker, Cornelius, NC (US)

( * ) Notice: Subject to any disclaimer, the term of this patent is extended or adjusted under 35 U.S.C. 154(b) by 0 days.

(21) Appl. No.: 15/694,776

(22) Filed: Sep. 2, 2017

(65) Prior Publication Data

US 2017/0360197 A1 Dec. 21, 2017

Related U.S. Application Data

(63) Continuation-in-part of application No. PCT/US2017/023917, filed on Mar. 23, 2017, and a (Continued)

(51) Int. Cl.

| | |
|---|---|
| ***A47B 81/00*** | (2006.01) |
| ***A47B 67/04*** | (2006.01) |
| ***A47B 96/18*** | (2006.01) |
| ***E05B 65/468*** | (2017.01) |
| ***E05C 1/08*** | (2006.01) |

(Continued)

(52) U.S. Cl.

CPC ..... *A47B 81/005* (2013.01); *A47B 67/04* (2013.01); *A47B 96/18* (2013.01); *E05B 65/467* (2013.01); *E05B 65/468* (2013.01); *E05C 1/08* (2013.01); *E05C 9/043* (2013.01); *G07C 9/00142* (2013.01); *G07C 9/00158* (2013.01); *A47B 88/483* (2017.01); *A47B 88/9412* (2017.01); *A47B 88/963* (2017.01); *A47B 2088/953* (2017.01); *E05C 9/047* (2013.01)

(58) Field of Classification Search

CPC ..... A47B 81/005; A47B 67/04; A47B 96/18; E05B 65/468; G07C 9/00142; G07C 9/0015; E05C 1/08

USPC ..... 312/215, 216, 217, 324, 257.1, 902, 409

See application file for complete search history.

(56) References Cited

U.S. PATENT DOCUMENTS 2,789,876 A 4/1957 Heilman et al.
2,913,296 A * 11/1959 Martin ..... E05B 65/467 292/259 R (Continued)

FOREIGN PATENT DOCUMENTS

WO 2005038181 4/2005

OTHER PUBLICATIONS

PCT, International Search Report for International Application No. PCT/US17/23917 dated Jun. 27, 2017.

(Continued)

*Primary Examiner* — James O Hansen
(74) *Attorney, Agent, or Firm* — Forrest Firm, P.C.

(57) ABSTRACT

A storage system is provided. The storage system includes an enclosure forming an open side exposing a face of a drawer, the drawer in translatable engagement with an interior of the enclosure. A first arm is secured to the enclosure and configured to pivot within the enclosure into a locked position and without the enclosure in an unlocked position. A translatable latch is provided for unlocking the first arm from the locked position. The latch translates through an aperture of the arm, the aperture being housed within the side of the enclosure for security when in the locked position.

17 Claims, 24 Drawing Sheets

Related U.S. Application Data continuation-in-part of application No. 29/558,182, filed on Mar. 15, 2016.

(60) Provisional application No. 62/311,912, filed on Mar. 23, 2016.

(51) Int. Cl.

| | |
|---|---|
| ***G07C 9/00*** | (2006.01) |
| ***E05B 65/467*** | (2017.01) |
| ***E05C 9/04*** | (2006.01) |
| *A47B 88/963* | (2017.01) |
| *A47B 88/483* | (2017.01) |
| *A47B 88/90* | (2017.01) |
| *A47B 88/95* | (2017.01) |

(56) References Cited

U.S. PATENT DOCUMENTS

| | | | | | |
|---|---|---|---|---|---|
| 2,958,423 | A | | 11/1960 | Caloiero et al. | |
| 3,762,787 | A | * | 10/1973 | Grubb | E05G 1/024 109/80 |
| 3,893,740 | A | * | 7/1975 | England | E05B 65/467 312/216 |
| D283,263 | S | | 4/1986 | Richey | |
| D408,538 | S | | 4/1994 | Simpkins et al. | |
| 5,314,244 | A | * | 5/1994 | Swets | E05B 65/467 211/181.1 |
| 5,488,914 | A | * | 2/1996 | Ouellette | E05G 1/005 109/50 |
| 5,915,802 | A | * | 6/1999 | Siler | E05B 65/467 109/47 |
| 6,074,026 | A | * | 6/2000 | Pinchuk | A47B 81/068 211/40 |
| 6,164,738 | A | * | 12/2000 | Dane | A61L 2/26 312/213 |
| 6,354,341 | B1 | | 3/2002 | Saveliev et al. | |
| 6,374,649 | B1 | | 4/2002 | Holcomb et al. | |
| 7,478,892 | B2 | | 1/2009 | Punzel et al. | |
| D636,615 | S | | 4/2011 | Grela | |
| D653,051 | S | | 1/2012 | Lin | |
| RE44,568 | E | | 11/2013 | Stepp | |
| D723,841 | S | | 3/2015 | Troyner et al. | |
| D741,624 | S | | 10/2015 | Freimuth | |
| 9,192,231 | B1 | | 11/2015 | Steffen | |
| 2002/0070640 | A1 | * | 6/2002 | Hamilton | E05B 65/467 312/107.5 |
| 2003/0141794 | A1 | | 7/2003 | Cleveland et al. | |
| 2006/0022560 | A1 | * | 2/2006 | Ashby | E05B 65/467 312/216 |
| 2007/0013280 | A1 | * | 1/2007 | Retchloff | B25H 3/00 312/319.8 |
| 2007/0164642 | A1 | | 7/2007 | Youngs et al. | |
| 2012/0007483 | A1 | * | 1/2012 | Wishlade | B25H 1/02 312/237 |
| 2012/0049714 | A1 | * | 3/2012 | Pallo | A47B 88/00 312/409 |
| 2016/0198852 | A1 | | 7/2016 | Liu | |
| 2016/0198853 | A1 | | 7/2016 | Liu | |

OTHER PUBLICATIONS

PCT, Written Opinion for International Application No. PCT/US17/23917 dated Jun. 27, 2017.

"WESTEC 2013: MM2 Storage CabineCabinet" Aug. 9, 2013, sme.org, site visited Mar. 27, 2017 <http://www.sme.org/MEMagazine/Article.aspx?id=74652&taxid=3013>.

* cited by examiner

GUN CABINET

CROSS-REFERENCE TO RELATED APPLICATIONS

This application is a bypass continuation-in-part of International Application No. PCT/US17/23917 filed Mar. 23, 2017, which claims the benefit of U.S. Provisional Patent Application 62/311,912 filed Mar. 23, 2016, the contents each of which are hereby incorporated by reference in their entirety.

This application is also a continuation-in-part of U.S. Design Patent Application 29/558,182 filed Mar. 15, 2016, the contents of which are hereby incorporated by reference in their entirety.

TECHNICAL FIELD

This disclosure is related to a storage system with translating drawers for secure storage of items, and more particularly a cabinet with translating drawers for secure, fire-resistant and water-resistant storage of firearms.

BACKGROUND

The safe storage of valuable and sentimental items is a ubiquitous concern. Storage should not only provide a safe place to store items, but should serve as a theft deterrent as well. Due to the environments in which some items are stored, or the particular nature of the items being stored, some storage systems advantageously provide protection against physical damage, such as is caused by fire, water or corrosion. Past systems have attempted to solve these problems, but have failed to provide sufficient theft deterrent and locking systems that are also easy and quick to operate for the layman, as well as sufficiently protect against physical damage. For example, thin gauges of steel, simple locking mechanisms and the lack of fire and water-resistant insulations are common issues. Further, past systems do not permit the additional functionality of serving as a workbench for handling the items stored therein, nor the ability to be securely bolted to a wall or floor.

Accordingly, there is a need for an improved storage system that not only serves as a safe place for storage, but also addresses the disadvantages associated with the storage systems of the prior art.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to at least one embodiment, a storage system is provided. The storage system includes an enclosure forming an open side exposing a face of a drawer, the drawer in translatable engagement with an interior of the enclosure; a first arm secured to the enclosure and configured to pivot within the enclosure into a locked position and without the enclosure in an unlocked position; and a translatable latch for unlocking the first arm from the locked position.

According to some embodiments, the storage system further includes a locking plane extending from the first arm and defining a locking aperture for receiving a latch therethrough, the latch translatable by a rod controlled by a switch.

According to some embodiments, the switch includes a key, a keyhole, and a rod, wherein the rod is translatable when the key is rotated within the keyhole.

According to some embodiments, the face of the drawer includes a fire-resistant layer therein.

According to some embodiments, the storage system further includes a spring pin engaged with the first arm when the first arm is in the locked position for biasing the first arm into the unlocked position when the first arm is unlocked by the lever.

According to some embodiments, the storage system further includes a water-resistant layer positioned between the enclosure and the face of the drawer for being compressed and forming a water-resistant seal when the first arm is in a locked position.

According to some embodiments, the first arm is L-shaped and extends across the face of the drawer and faces of additional drawers.

According to some embodiments, the storage system further includes a top layer secured to a top of the enclosure for providing a work surface, the top layer defining holes or slats for selectively engaging a firearm mount.

According to some embodiments, the storage system further includes a second arm pivotably secured to the enclosure and positioned distal to the first arm, wherein the second arm is configured to pivot within the enclosure into a locked position and without the enclosure in an unlocked position, and wherein the lever is configured to unlock the second arm from the locked position simultaneously with the unlocking of the first arm from the locked position.

According to some embodiments, the storage system further includes a partition bisecting the open side, wherein the drawer is positioned on one side of the partition and an additional drawer having an additional face is positioned on the other side of the partition, wherein the additional drawer is in translatable engagement with the interior of the enclosure; a third arm pivotably secured to the enclosure and positioned proximal to the first arm, wherein the third arm is configured to pivot within the enclosure into a locked position and without the enclosure in an unlocked position; and a second lever for unlocking the third arm from the locked position.

According to some embodiments, the storage system further includes a fourth arm pivotably secured to the enclosure and positioned distal to the first arm and the third arm, wherein the fourth arm is configured to pivot within the enclosure into a locked position and without the enclosure in an unlocked position, and wherein the second lever is configured to unlock the fourth arm from the locked position simultaneously with the unlocking of the second arm from the locked position.

According to some embodiments, the storage system further includes a locking plane extending from the third arm and defining a locking aperture for receiving a latch therethrough, the latch translatable by the second lever.

According to some embodiments, the storage system further includes a switch engaged with the second lever for controlling the translation thereof.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

The storage system 10 described herein may be used for storing any number of items, such as weapons, jewelry, sentimental artifacts, documents, photographs, tools, etc. For consistency and simplicity of style, the disclosure will refer to items 1 generally as firearms or guns, without any intent to limit the disclosure thereto. Notably, firearms 1 have qualities that necessitate many features of the storage system described herein—safe storage and theft deterrence, protection from physical damage and a working platform, for example. In some instances, the storage system 10 may be also referred to as a gun cabinet or firearm cabinet.

Figure 1:
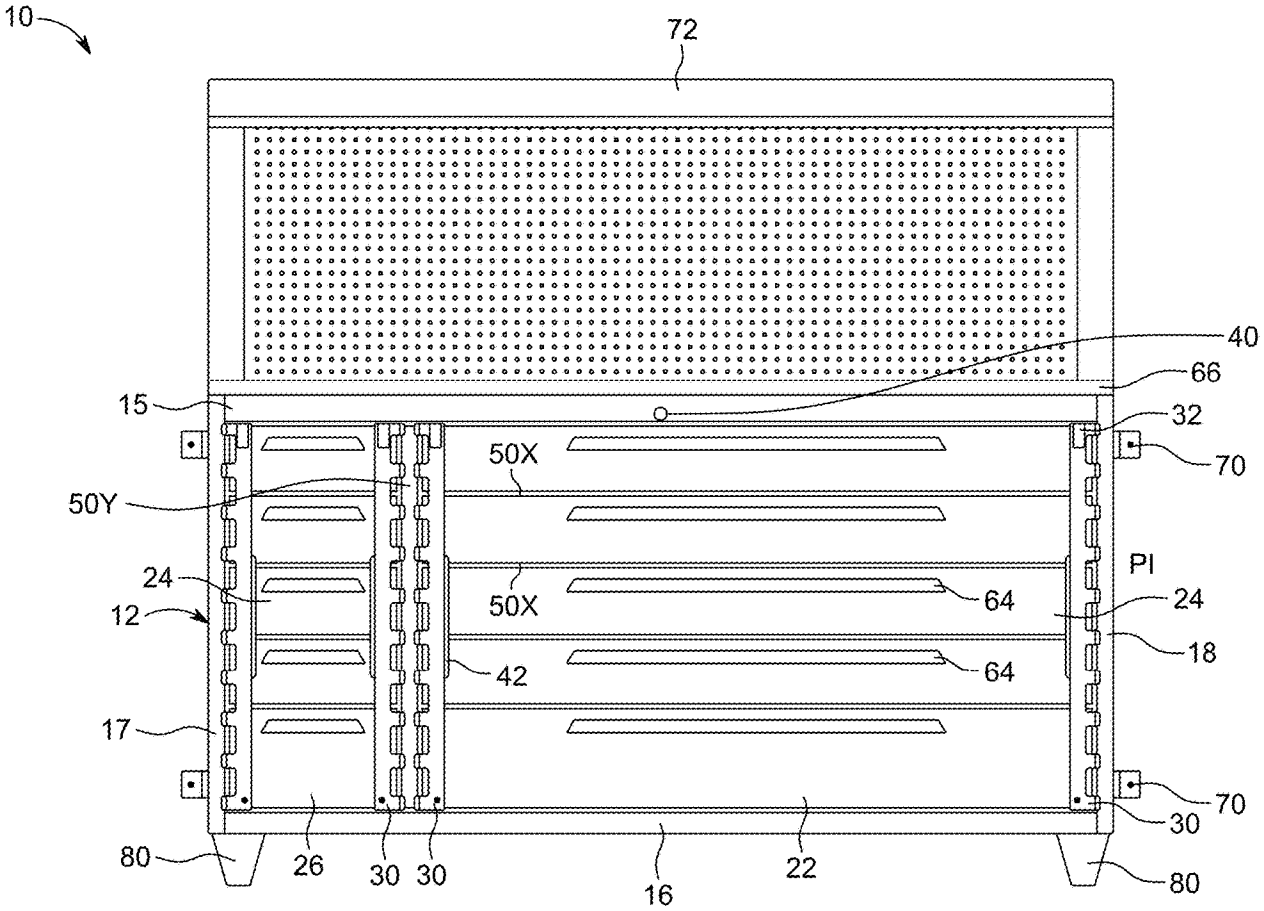
FIG. 1 illustrates a front view of the storage system according to one or more embodiments disclosed herein.

FIG. 1 illustrates a storage system 10 for storing items 1 according to at least one embodiment of the invention. The storage system 10 comprises an enclosure 12 defining an open side 20. The enclosure 12 may also define five closed sides—a top 15, a bottom 16, a left side 17, a right side 18, and a back side 19—and may be comprised of a metal. The sides 15-20 may form a cuboid. The metal may be a standard or galvanized steel and may vary from fourteen to twenty gauge, for example. Each of the five sides 15-19 may have an interior-facing portion 14 positioned opposite an exterior-facing portion 13. The open side 20 of the enclosure 12 may be front-facing, opposite the back side 19.

The faces 24 of at least one drawer 22 and/or at least one additional drawer 26 may be positioned within the open side 20, and may include an outer perimeter or lip 62 overlapping with the top, bottom, left and/or right sides 15-18. Further, the drawer(s) 22, 26 may be translatably engaged with, or coupled to, an interior 14 of the enclosure and/or a vertical partition 50Y positioned within the enclosure 12. In some embodiments, the interior 14 may be defined by any combination of the sides of the enclosure 12, while in other embodiments, the interior 14 may further be defined by surfaces of partitions 50X, 50Y within the enclosure 12.

Figure 2:
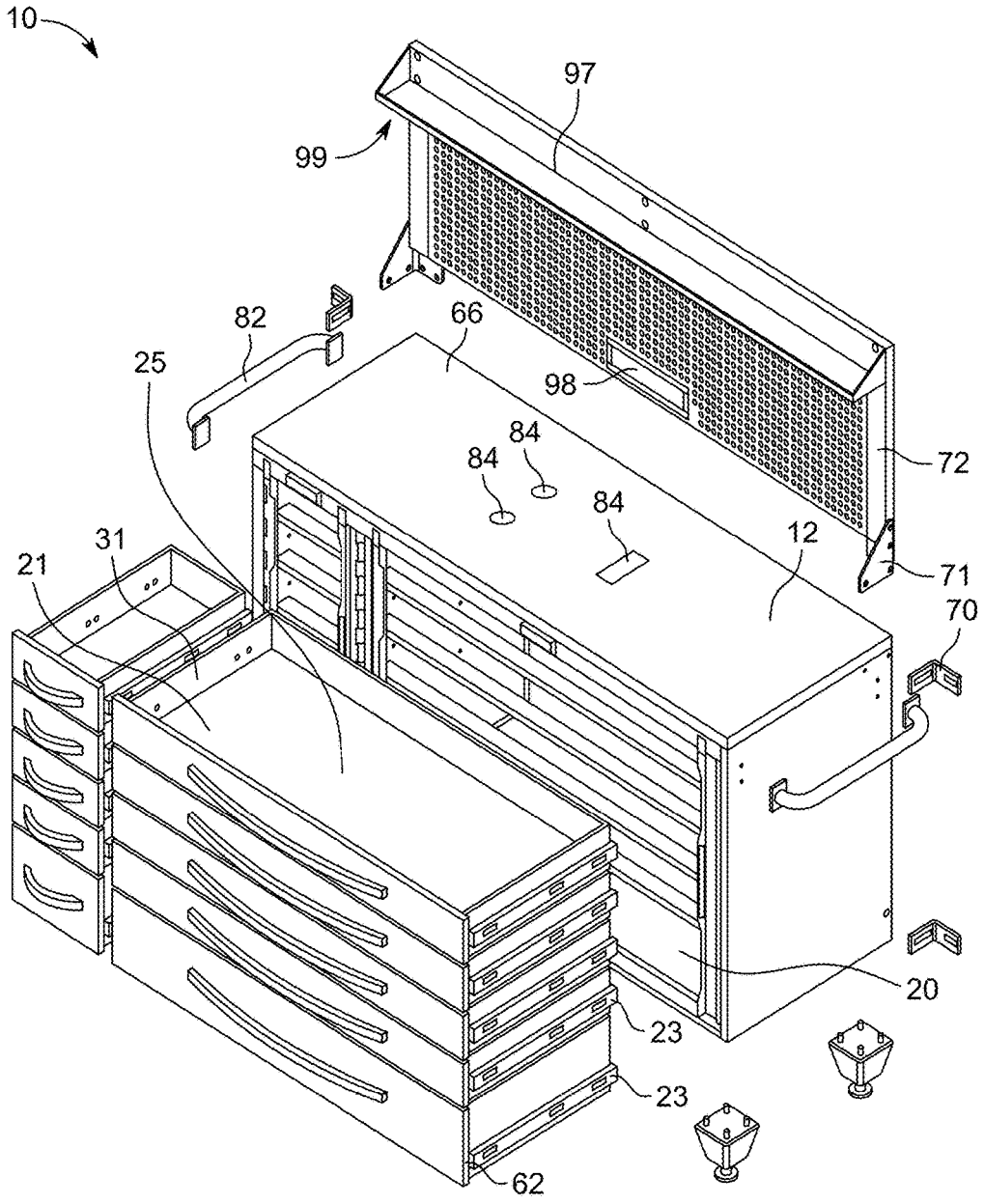
FIG. 2 illustrates a perspective, exploded view of the storage system according to one or more embodiments disclosed herein.

As seen in the exploded view of FIG. 2, the storage system 10 may include a plurality of drawers 22 and additional drawers 26. As described more fully herein, the drawers 22 and additional drawers 26 may be translatable within separate, selectively engageable enclosures 12, or, as depicted in FIG. 2, may form a single enclosure 12, divided by a vertical partition 50Y. The drawers 22, 26 may be translatable within the interior 14 of the enclosure 12 through the open side 20. Each set of drawers 22 and additional drawers 26 may include a plurality of drawers 22, 26 arranged in a vertical column, separated by a distance between each drawer 22, 26. The side edges of the face 24 of the drawers 22, 26 may be parallel.

In some embodiments, the storage system 10 may be secured to a floor or wall or other surface using at least one securing bracket 70 or by positioning a fastener through the back side 19 of the enclosure 12 to the floor or wall or other surface. For example, as depicted in FIG. 2, a securing bracket 70 may be an L-shaped bracket coupled to the left side 17 and right side 18 of the enclosure 12. In some embodiments, the storage system 10 may include legs, casters or some other support 80, static or moveable, affixed to the bottom side of the enclosure 12. Although FIG. 2 depicts stationary legs 80, legs 80 with wheels may be included. Further, the legs or other support 80 may be secured to the floor using a bolt, bracket or some other fastener. In some embodiments of the support 80, a twist mechanism for locking the support 80 into position may be included. The twist mechanism may permit unlocking the support 80 for engaging a wheel of the support 80 with the surface on which the enclosure 12 stands for moving the enclosure 12. The support 80 may include alternative locking mechanisms or mobile mechanisms.

Rack arms 82 may be engageable with or coupled to the enclosure 12. The rack arms 82 may be handle-like arms for hanging material or objects, providing support during work, or providing support when repositioning or moving the storage system 10. The rack arms 82 may include one or more trays for storing work tools or materials, for example.

Figure 3:
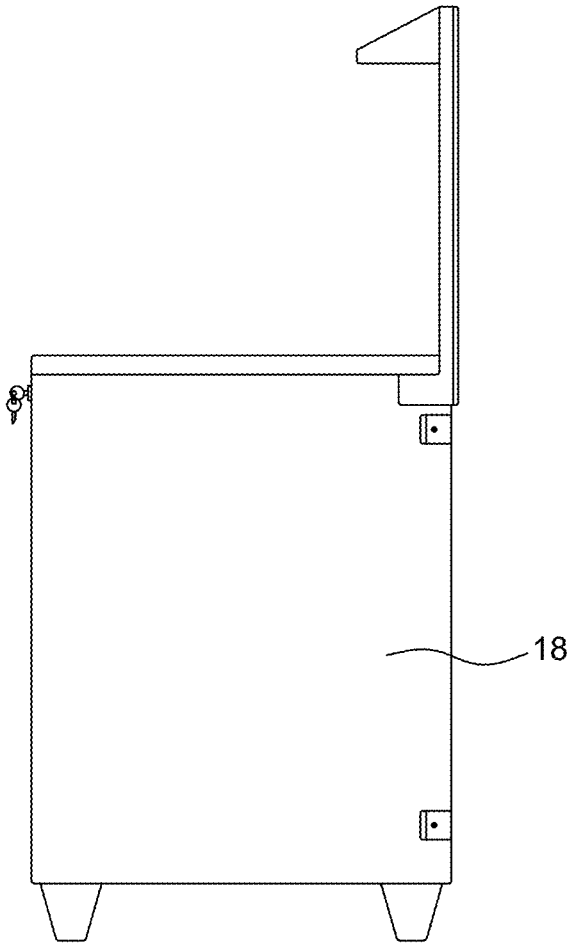
FIG. 3 illustrates a side view of the storage system according to one or more embodiments disclosed herein.
Figure 4:
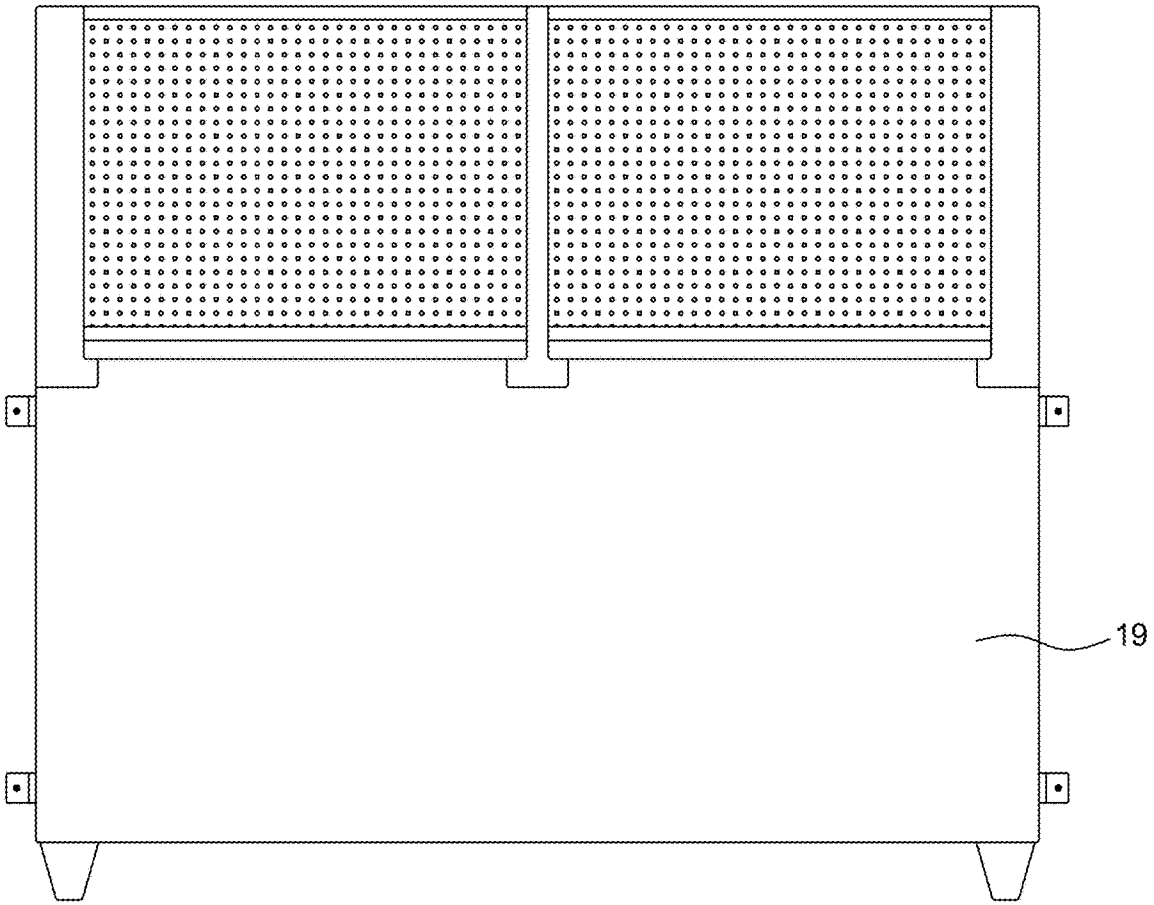
FIG. 4 illustrates a rear view of the storage system according to one or more embodiments disclosed herein.

In some embodiments of the present invention, the storage system 10 further includes a top layer 66 secured to, or forming the exterior 13 of, a top side 15 of the enclosure 12 for providing a work surface. The top layer 66 may be comprised of wood, metal, plastic, rubber or a combination thereof. The top layer 66 may be selectively engageable with one or more firearm mounts 95 for positioning a firearm during cleaning and/or repair. For example, the top layer may include pre-drilled holes or slats 84 for securely fastening the one or more firearm mounts 95. A side view of one embodiment of the storage system 10 is depicted in FIG. 3. A rear view of one embodiment of the storage system 10 is depicted in FIG. 4.

According to some embodiments, at least one drawer 22 may be included in the storage system 10. In at least one embodiment, a plurality of drawers 22 may be provided in a parallel, stacked arrangement, forming a column, as described herein. In another embodiment, an additional drawer 26 may be provided parallel and adjacent to the at least one drawer 22, or, alternatively, a plurality of additional drawers 26 in a parallel, stacked arrangement, forming an additional column, as described herein. The columns may be engageable with each other or may form a unitary portion of the enclosure 12. In some embodiments, the number of drawers 22 and additional drawers 26 are equal, while in other embodiments, the number differs.

Referring to FIGS. 2, 5, 7 and 8, each of the drawers 22, 26 may be translatably engaged with the enclosure 12 using any number of drawer slides 23. The drawer slides may be coupled to the left and right sides of the drawers 22, 26, as well as the interior 14 of the enclosure 12 and/or any vertical partitions 50Y of the enclosure 12. The vertical partition(s) 50Y may extend the entire height of the open side 20, or may extend only a portion of the height, and may be positioned at any point along the width of the open side 20. Any partition 50Y may extend the entire depth of the interior 14 of the enclosure 12. The partition(s) 50 may effectively partition the interior of the enclosure 12 into two parts per partition 50. In some embodiments, drawer(s) 22 may be positioned on one side of the partition 50Y while additional drawer(s) 26 may be positioned on the other side of the partition 50Y. In some embodiments, the additional drawers 26 may be smaller in width than the drawers 22 for housing smaller items 1 in comparison to the larger items 1 in the larger drawers 22. In an embodiment of the storage system 10 comprising a vertical partition 50Y, one or more arms 30 may be pivotally secured thereto, as described herein.

The enclosure 12 of the storage system 10 may further include one or more horizontal partitions 50X for partitioning the enclosure 12 horizontally. The horizontal partition(s) 50X may extend the entire width of the enclosure 12 or may extend from one side of the enclosure 12 perpendicularly into engagement with the vertical partition 50Y. In some embodiments, the horizontal partitions 50X may be an L-shaped bracket running a length along the open side 20. In some embodiments, multiple horizontal partitions 50X may be provided, at least one extending from one side of the enclosure 12 to the vertical partition(s) 50Y, at least one extending from the other side of the enclosure 12 to the vertical partition(s) 50Y, at least one extending between vertical partitions 50Y, and/or at least one extending across the entire width of the enclosure 12.

According to at least one embodiment, each of the drawers 22, 26 may include a face 24. The face 24 may be positioned on a side of the drawer 22, 26 facing outwardly from the open side 20 of the enclosure 12. The face 24 may extend beyond the interior storage volume 25 of the drawer 22, 26, defined by the drawer bottom 21 and sides 31, in the vertical and/or horizontal direction, thereby defining a lip 62 around the drawer 22, 26.

Any or each of the drawers 22, 26 may include a handle 64 for translating the drawer 22 with respect to the enclosure 12. The handle 64 may be recessed within the face 24 or may extend from the face 24. For example, the handle 64 may have a plane extended from the face 24 at an angle for a certain distance, with a triangular portion of the handle 64 extending between each edge of the plane to the face 24 of the drawer 22. The handle 64 may be secured to the face 24 using any fastener(s), such as threaded bolt(s) with a rubber washer. The handle 64 may arch away from the drawer face 24.

Figure 5:
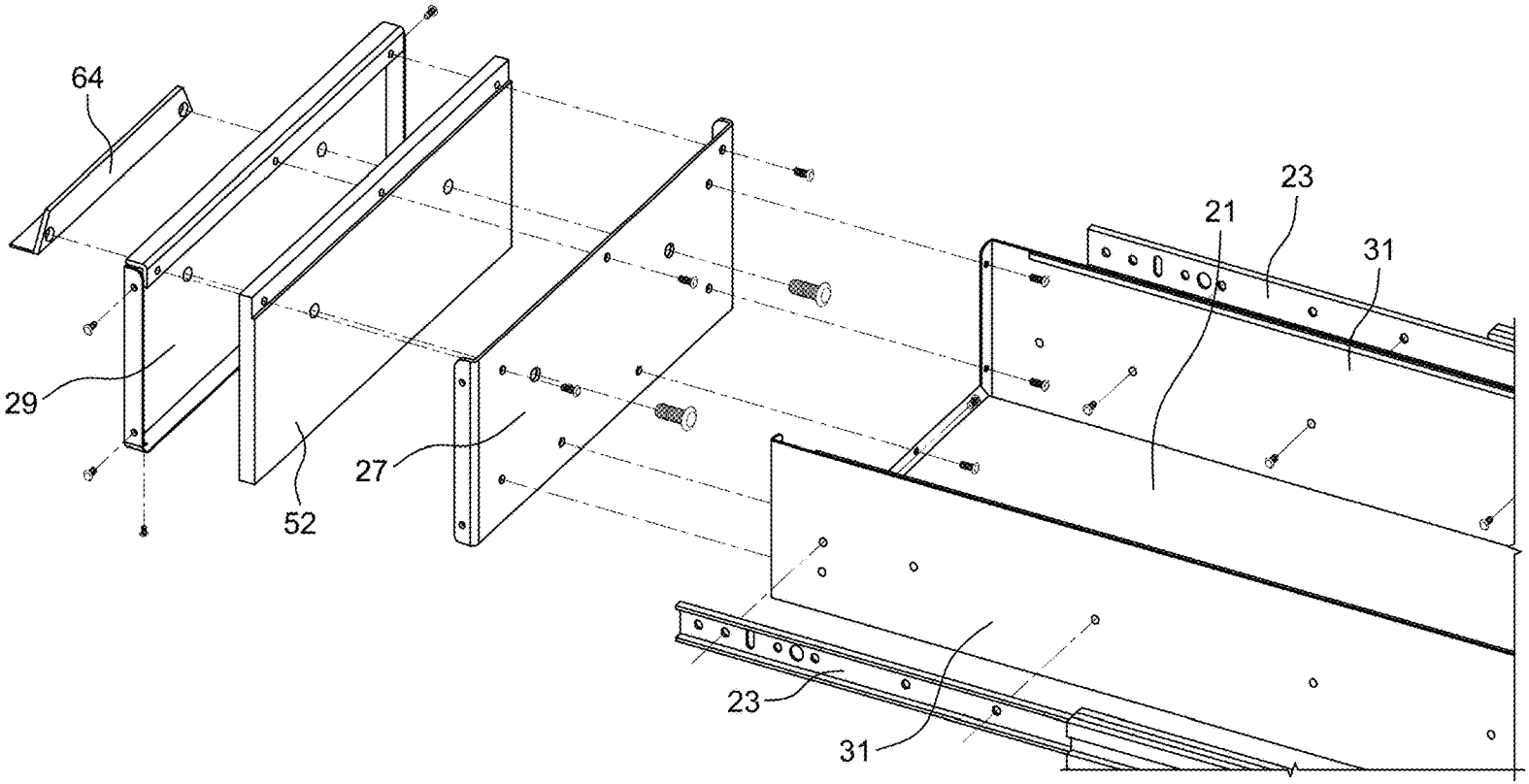
FIG. 5 illustrates an exploded view of a drawer of the storage system according to one or more embodiments disclosed herein.
Figure 6:
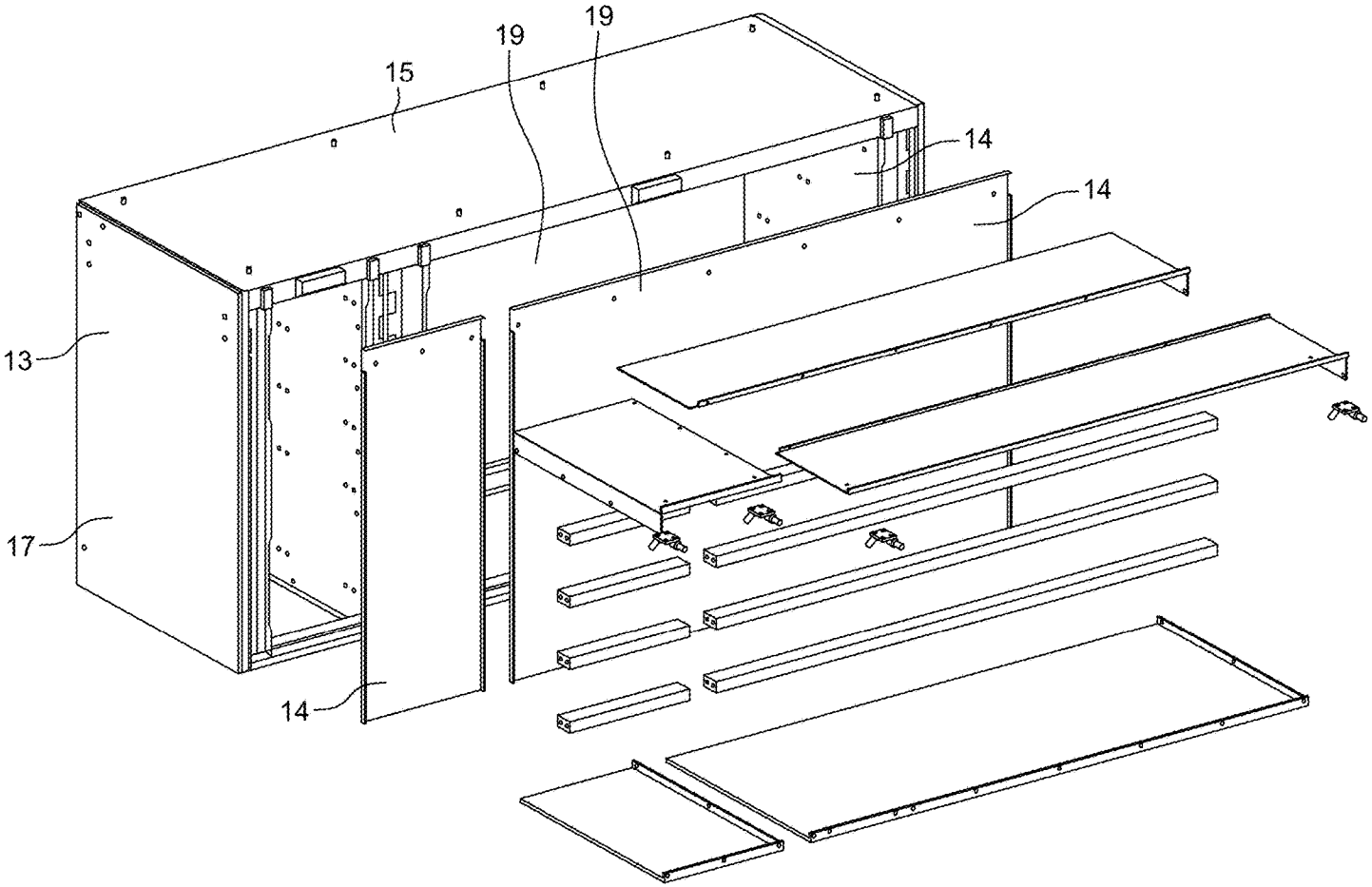
FIG. 6 illustrates a perspective, exploded view of the enclosure of the storage system according to one or more embodiments disclosed herein.

Referring to FIG. 5, the drawer 22, 26 may define a drawer interior 25 in which items 1 may be stored. The face 24 of the drawer may include a face back 27 and a face front 29. When fully assembled, the face 24 may extend beyond the storage dimensions of the interior 25 in both the horizontal and vertical directions and define a lip 62. FIGS. 5-8 illustrate embodiments of the storage system 10 containing resistant materials 52, 54. The enclosure 12 and/or the drawer(s) 22, 26 may include fire-resistant materials 52 and/or water-resistant materials 54 for providing protection against damage to the items 1 stored within the enclosure 12.

FIG. 5 illustrates fire-resistant materials 52 positioned between the face back 27 and face front 29 of the face 24 of the drawers 22, 26. Therefore, in the event of a fire, the fire-resistant materials 52 would seal the open side 20 of the enclosure 12, protecting the items housed therein from fire and heat damage. The fire-resistant layer 52 may also serve as an insulating layer against cold temperatures. In other embodiments, any or each of the sides 15-19 of the enclosure 12 or partitions 50 may include a fire-resistant layer 52 therein or thereon. Further, a portion of the interior 14 of the top side 15, bottom side 16, left side 17 and/or right side 18 proximal the open side 20 may include fire-resistant materials 52 thereon or therein along the height and/or width of the open side 20 of the enclosure 12. The vertical partition(s) 50Y and/or horizontal partition(s) 50X may include a fire-resistant layer of materials 52 positioned proximal to the open side 20 of the enclosure 12. In some embodiments, the entire interior 14 the enclosure 12 may include fire-resistant materials 52 therein or thereon.

In some embodiments, blankets of fire-resistant materials 52 may be positioned between panels of each of the sides 15-18. For example, turning to FIG. 6, the back side 19 is comprised of at least two panels, between which a blanket of fire-resistant materials 52 may be positioned for protecting the interior and items 1 of the enclosure 12 from fire and extreme temperatures outside of the enclosure 12.

Figure 7:
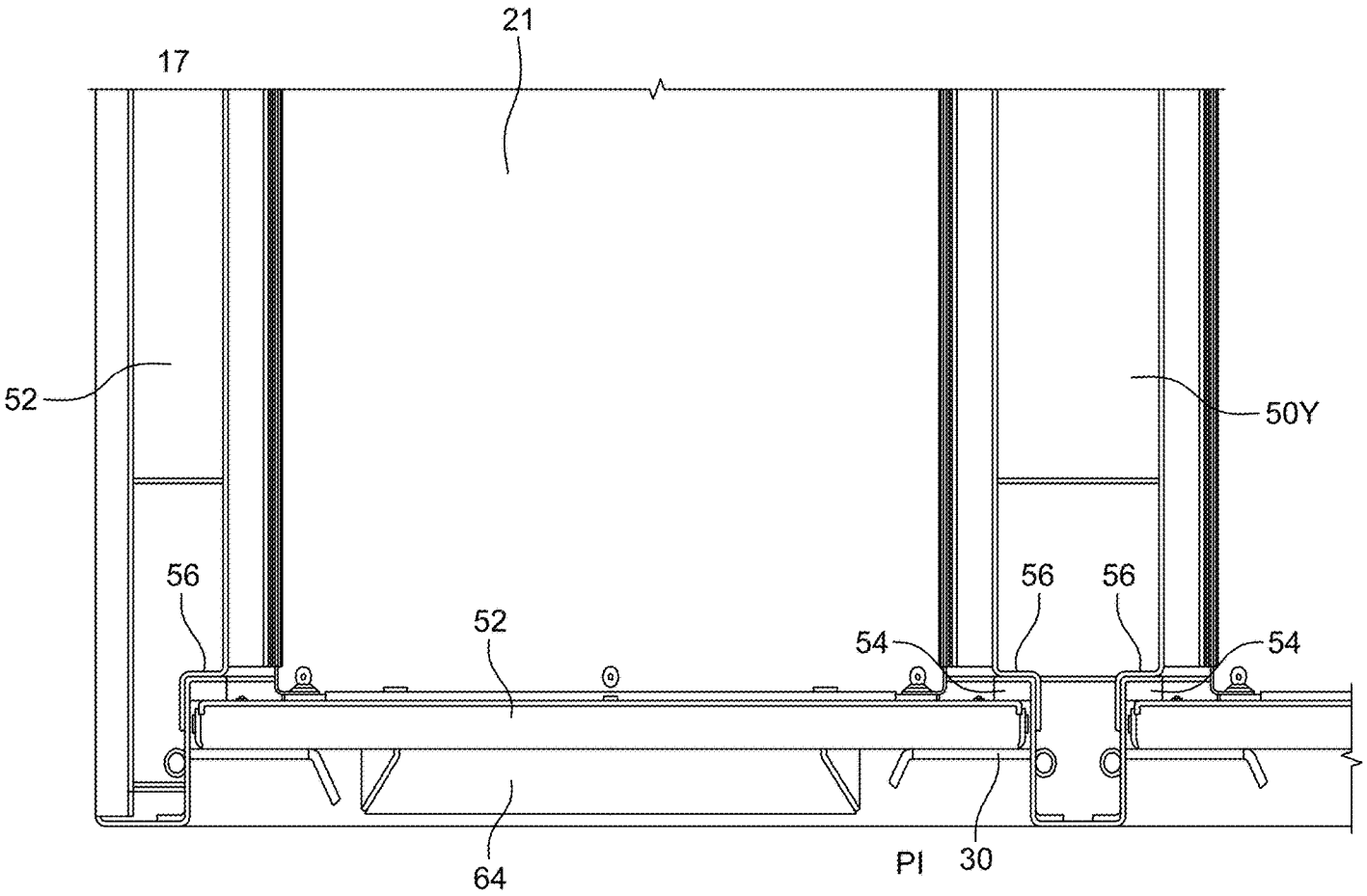
FIG. 7 illustrates a top view of the drawers and enclosure according to one or more embodiments disclosed herein.

In some embodiments, water-resistant layers of material 54 may be provided for protecting the items 1 stored in the storage system 10 from water damage (see FIG. 7). The water-resistant layer 54 may be compressible such that compression of the water-resistant layer 54 enhances its water-resistant protection qualities by becoming denser. In some embodiments, the water-resistant layer 54 may also function as a fire-resistant layer 52 and/or an insulating layer. In other embodiments, the fire-resistant layer 52 may also function as a water-resistant layer 54 and/or an insulating layer. The water-resistant layer 54 may be comprised of rubber, foam, plastic, silicone or a combination thereof.

A water-resistant layer 54 may positioned between the enclosure 12 and the face 24 of the drawer 22 for being compressed and forming a water-resistant seal when an arm 30 is in a locked position P1. In one embodiment, the water-resistant layer 54 may be positioned on an interior-facing side of the face 24 and/or lip 62 of the drawer 22. The water-resistant layer 54 may run the entire width and height of the face 24 and/or lip 62 such that a closed rectangle is formed around the drawer body or interior 25. As the drawer 22 is translated by engagement of an arm 30 with the drawer face 24, the interior-facing side of the drawer face 24 containing the water-resistant material 54 may be compressed against the corresponding portions of the enclosure 12, such as the horizontal partition(s) 50X, vertical partition (s) 50Y, sides of the enclosure 12, a lip or inset 56 of the sides of the enclosure 12, and/or any other part of the enclosure 12. In other embodiment, the water-resistant layer 54, or a portion thereof, is also or alternatively positioned on at least an externally-facing portion of the enclosure 12 onto which the internally-facing side of the drawer face 24 may be engaged when in the locked position P1. In some embodiments, the water-resistant layer 54 is duplicated on both the drawer face 24 and the enclosure portions.

FIG. 7 depicts an embodiment of the enclosure 12 including a left side 17 and a vertical partition 50Y including notch(s) 56. The water-resistant material 54 may be positioned on the notch 56 along a height of the partition 50Y or side 17, 18. Further, a top or bottom side 15, 16, and/or a horizontal partition 50X may define notch(s) 56 for accepting water-resistant material 54 thereon.

Figure 8:
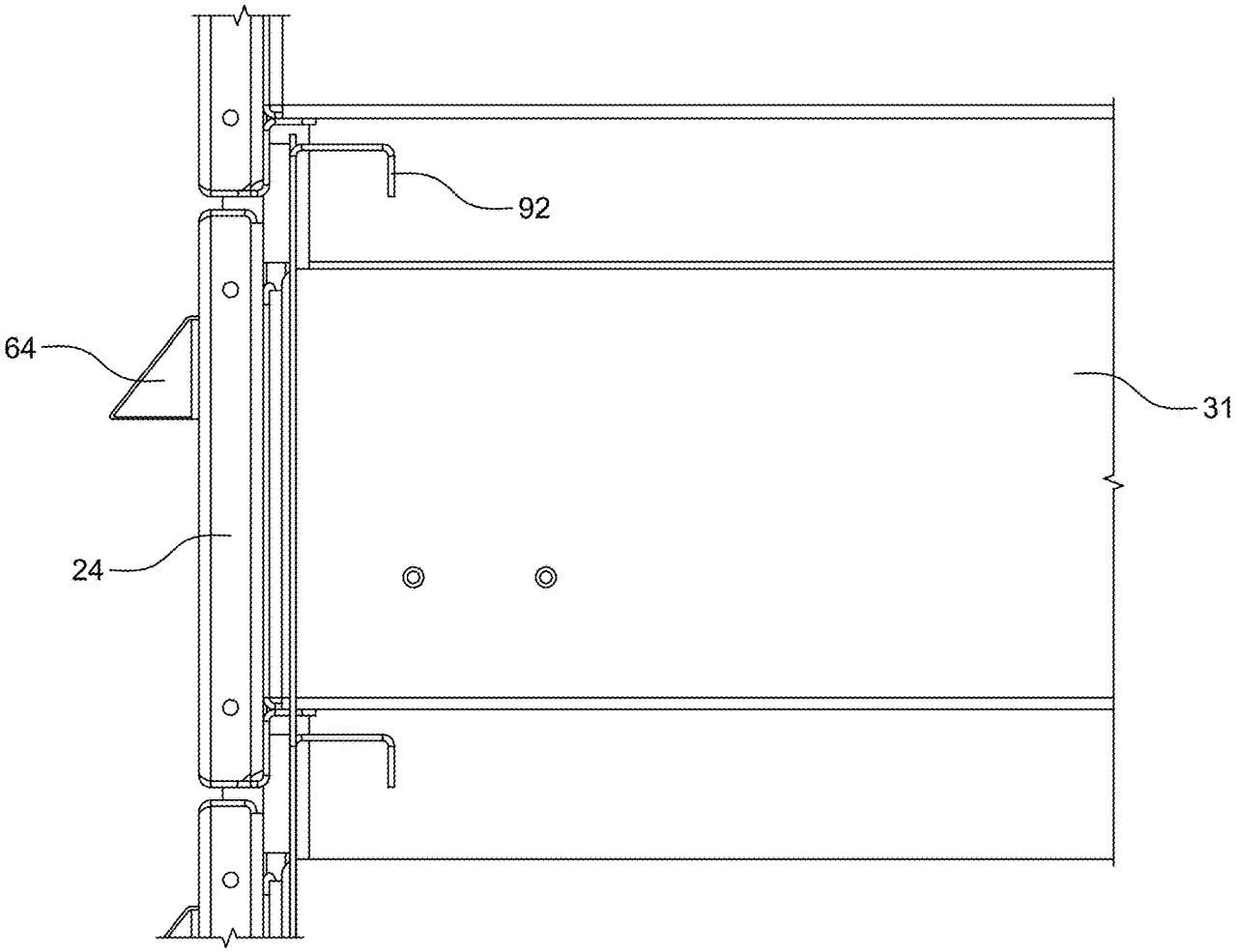
FIG. 8 illustrates a side view of the drawers and enclosure according to one or more embodiments disclosed herein.

FIG. 8 illustrates a stop 92 positioned below a horizontal partition 50X for ceasing translation of a drawer 22, 26 when the drawer 22, 26 is being translated without the enclosure 12. A rear of the drawer 22, 26 may contain a stop compliment 94 for contacting the stop 92 when the drawer is translated. The stop compliment 94 may extend below the drawer interior 25 from a rear or underside of the drawer 22, 26, thereby permitting contact of the stop compliment 94 and stop 92 when the drawer face 24 is extended from the open side 20 a certain distance.

Figure 9:
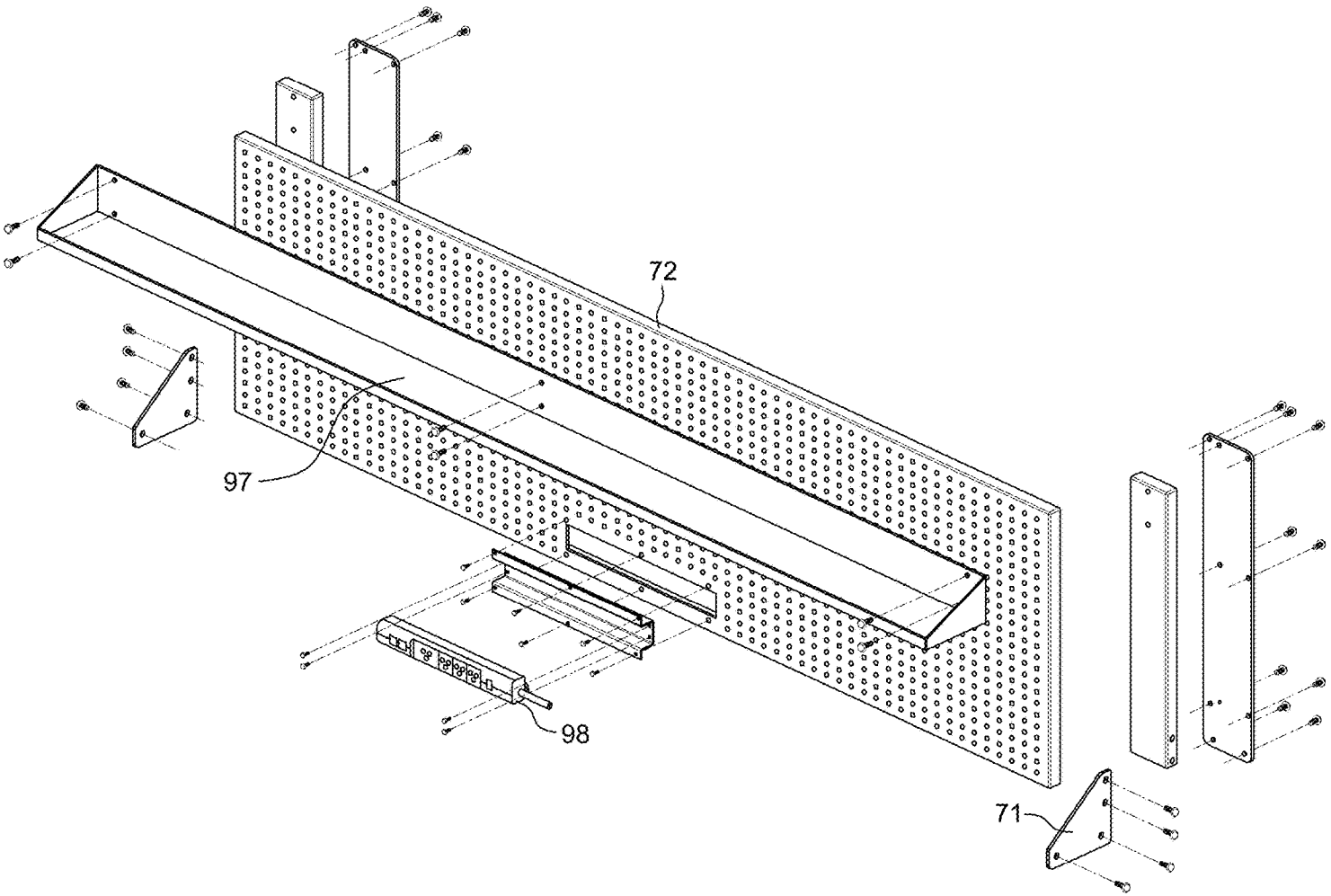
FIG. 9 illustrates an exploded view of the backboard according to one or more embodiments disclosed herein.

Referring to FIG. 9, the storage system 10 may further include a backboard 72 engageable with or coupled to the enclosure 12. The backboard 72 may extend parallel to the back side 19 of the enclosure 12, extending upwards and away from the enclosure 12. The backboard 72 may be a pegboard, a shelving system or any other structure. The backboard 72 may include a lighting element 99, electrical outlets and/or power strips 98, and/or one or more shelves 97. A backboard bracket 71 may be provided to further secure the backboard 72 into position relative to the enclosure 12. The bracket 71 may be engaged with or coupled to the backboard 72 and the left or right side 17, 18 of the enclosure 12.

Figure 10:
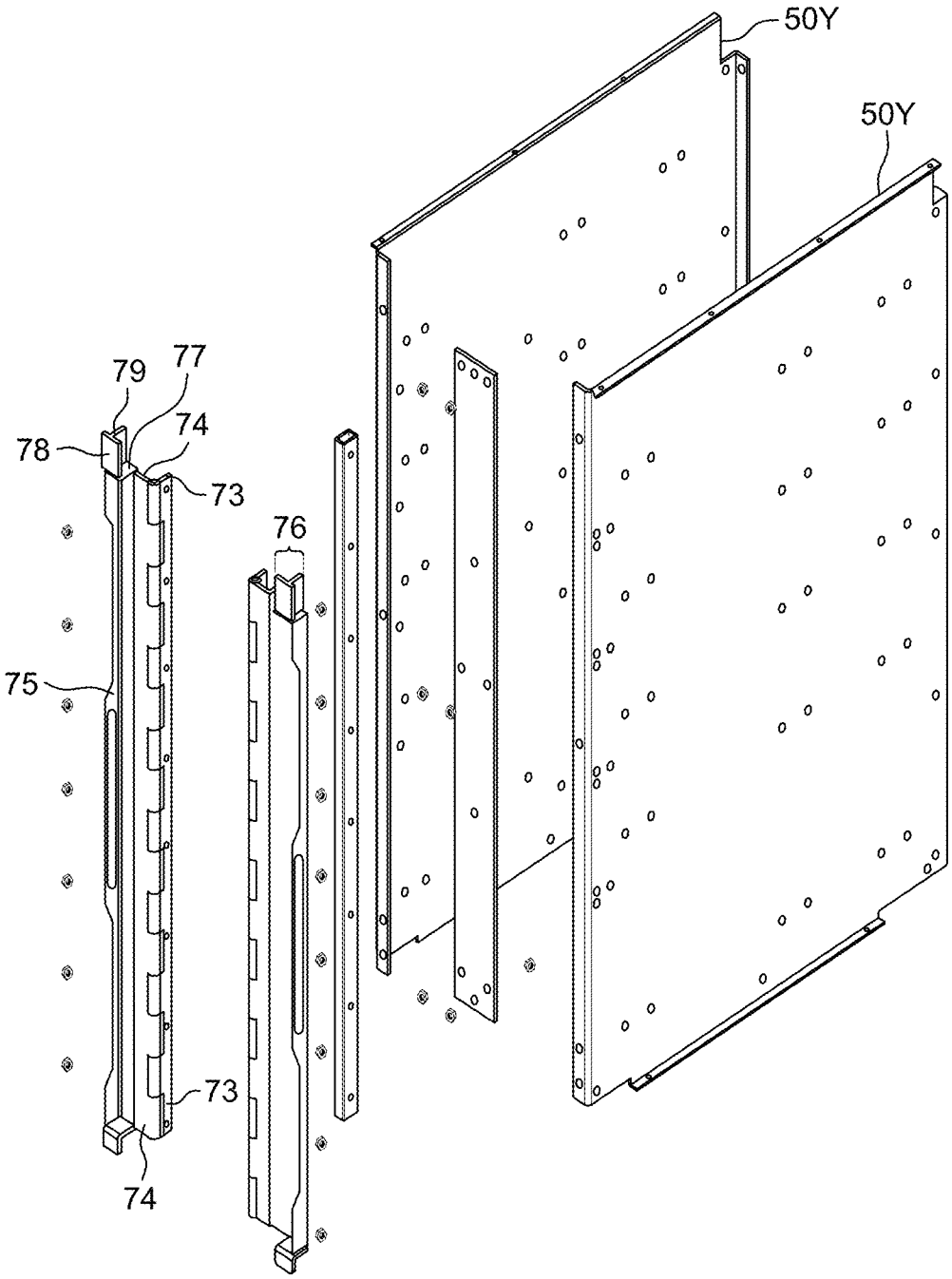
FIG. 10 illustrates an exploded view of two arms according to one or more embodiments disclosed herein.
Figure 11:
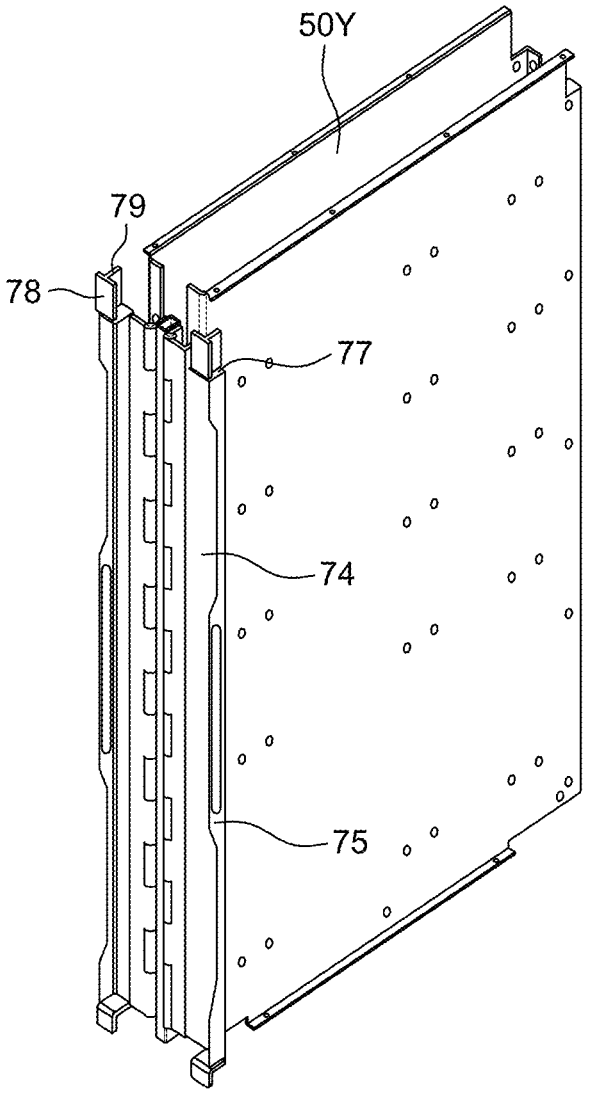
FIG. 11 illustrates a perspective view of two arms according to one or more embodiments disclosed herein.

FIGS. 10 and 11 illustrate embodiments of the storage system 10 including at least one arm 30. The at least one arm 30 may be secured, at one or more points, to the left side 17, right side 18 and/or the vertical partition 50Y of the enclosure 12. The arms 30 may be pivotally secured to the enclosure 12 using a fastener, such as a cylindrical rod and a pivot hinge, or a piano hinge. The storage system 10 may include a first arm 30A, a second arm 30B, a third arm 30C, a fourth arm 30D, and/or additional arms 30X. The arms 30 may extend the entire height, or a portion of the entire height, of the open side 20 of the enclosure 12.

In some embodiments of the invention, each arm 30 may define an engaging plane 73, a pivoting plane 74, a gripping plane 75 and a locking configuration 76. The engaging plane 73 may be secured to the enclosure 12. The pivoting plane 74 may be pivotally secured to the engaging plane 73 using, for example, a piano hinge having a pivot bar extending through apertures defined by the engaging plane 73 and the pivoting plane 74. The gripping plane 75 may be any surface extending from the pivoting plane 74 for permitting the arm 30 to be gripped or maneuvered. The gripping plane 75 may define or include a handgrip 42. The handgrip 42 may be shaped or configured for providing a gripping surface for the user to pivot the arm 30 between a locked position P1 and an unlocked position P2. The arms 30 may define a locked position P1 when the pivoting plane 74 is parallel with the open side 20 of the enclosure 12 and/or perpendicular with the engaging plane 73. Whenever the pivoting plane 74 pivots away from the open side 20 and out of the locked position P1, the arm will define an unlocked position P2. One skilled in the art will understand that minimal movements may be permitted when the arm 30 is in the locked position P1, given the tolerances of components of the system 10; in other embodiments, seals may be provided on the components to further eliminate minimal movements of the arm in the locked position P1.

The arms 30 of FIGS. 10 and 11 define a locking configuration 76 extending between a topmost edge of the gripping plane 75 and the pivoting plane 74. In some embodiments, the topmost edges of the gripping plane 75 and the pivoting plane 74 are perpendicular to each other. The locking configuration 76 may include a horizontal portion 77 extending between the topmost edges of the gripping plane 75 and the pivoting planes 74. The locking configuration 76 may further include a vertical portion 78 extending from an edge of the horizontal portion 77 most distal from the pivoting plane 74, the vertical portion 78 extending parallel to the pivoting plane for engagement with a top side 15 of the enclosure 12 when the arm 30 is in a locked position P1. A locking portion 79 may bisect both the horizontal portion 77 and the vertical portion 78, be positioned perpendicular to the pivoting plane 74, and extend from the vertical portion 78 and towards the plane formed by the pivoting plane 74. A locking aperture 37 may extend through the locking portion 79 for accepting a locking latch 34.

Notably, as is depicted in FIGS. 10 and 11, when two arms 30 having locking configurations 76 are positioned proximal to each other, pivoting planes 74 of each arm may extend away from each other towards the gripping plane 75 when in the locked position P1. In such instances, the length of the pivoting plane 74 of one arm 30 may be greater than the length of the pivoting plane 74 of a second arm 30 for ensuring that the pivoting planes 74 of both arms may pivot towards each other. When both the longer and the shorter pivoting planes 74 of adjacent arms 30 are perpendicular with the open side 20 of the enclosure 12, the gripping plane 75 and locking configuration 76 of the arm 30 with the shorter pivoting plane 74 will be positioned between the gripping plane 75 and locking configuration 76 of the arm 30 with the longer pivoting plane 74 and the open side 20. By configuring adjacent arms 30 to have a shorter and longer pivoting plane 74, both arms may be pivoted at least ninety degrees, permitting the both adjacent drawer 22 and additional drawer 26 to translate simultaneously and permitting a more compact enclosure 12 (e.g., smaller width).

Figure 12:
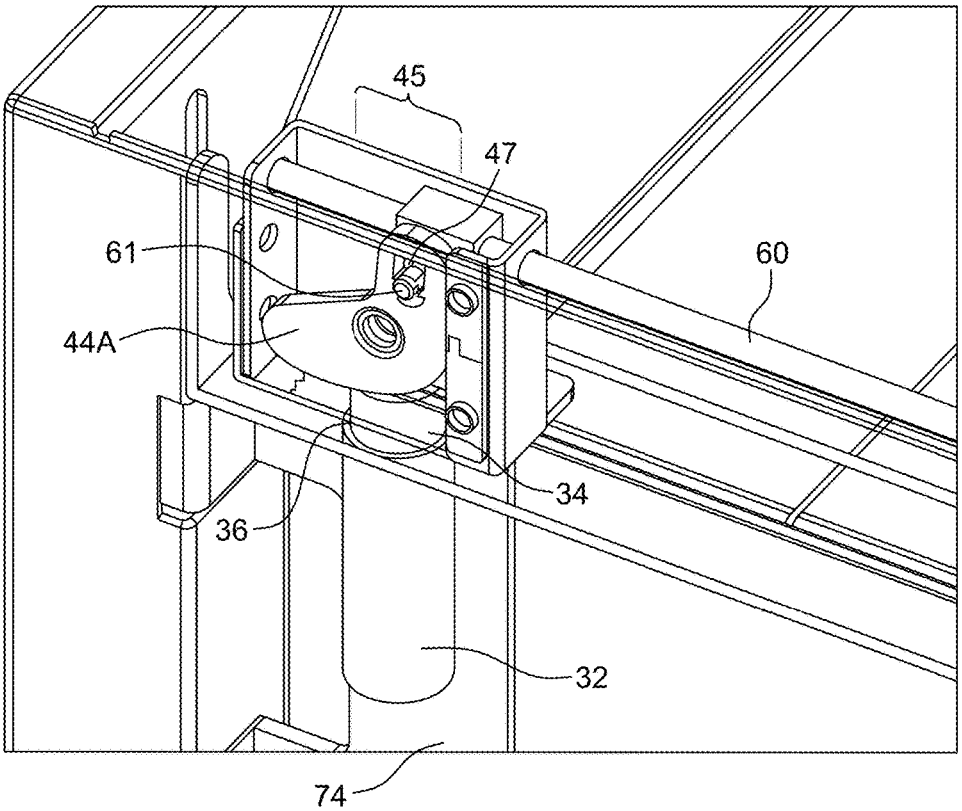
FIG. 12 illustrates a view of the lever system according to one or more embodiments disclosed herein.
Figure 13:
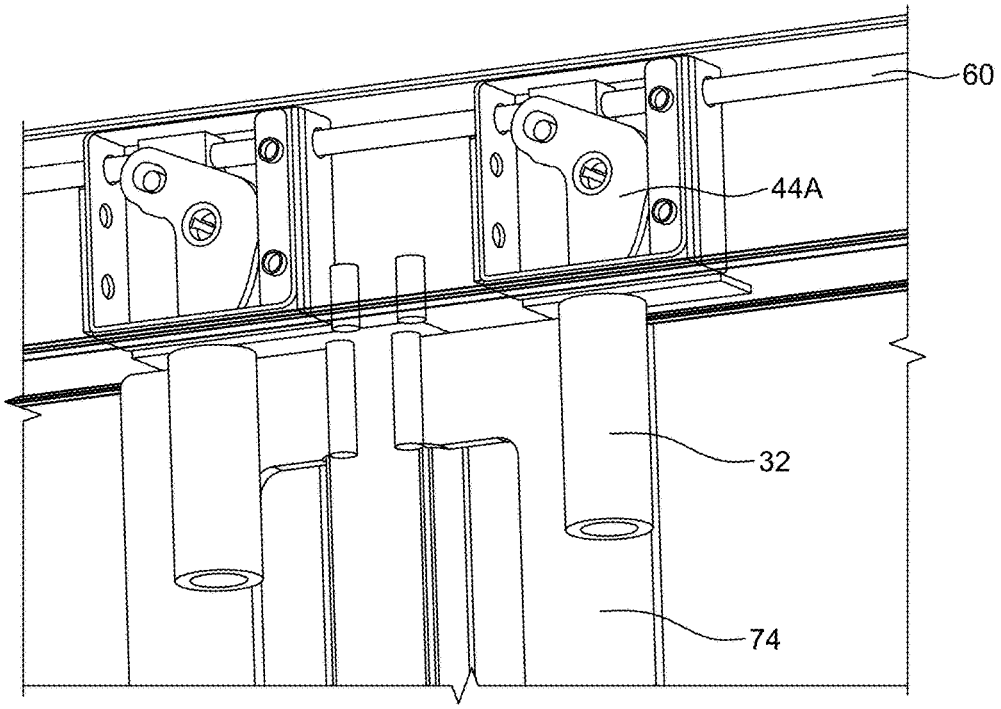
FIG. 13 illustrates a view of two lever systems according to one or more embodiments disclosed herein.

In some embodiments of the invention, as is depicted in FIGS. 12 and 13, the arm 30 may define a receptacle 32. The receptacle 32 may be positioned anywhere along an uppermost portion of the arm 30 and may be cylindrically shaped. Further, the receptacle 32 may house a translatable latch 34 therein. The latch 34 may be biased to protract from the receptacle 32, for example, by the use of a spring housed within the receptacle 32 and in engagement with a base of the receptacle 32. The receptacle 32 may be positioned on the uppermost portion of the pivoting plane 74 on a side of the pivoting plane 74 facing away from the enclosure 12, as depicted in FIGS. 12 and 13. Further, the arm 30 may or may not include an engaging plane 73. Instead, the pivoting plane 74 of the arm may be pivotally engaged directly with the enclosure 12 itself, through, for example, the use of a piano hinge.

Any of the arms 30 may have at least two positions—a locked position P1 and an unlocked position P2. The arm 30 may be in a locked position P1 when the latch 34 protracts through an enclosure aperture 36 of the enclosure 12, when the pivoting plane 74 engages one or more drawers 22, 26 and is parallel with the open side 20 of the enclosure 12, and/or when a latch 34 extends through the locking aperture 37 of the locking configuration 76. The enclosure 12 may define any number of enclosure apertures 36 for receiving the latch 34 of any number of arms 30 and/or the locking portion 79 of a locking configuration 76. The enclosure apertures 36 may be defined by the interior 14 of the enclosure 12.

When the latch 34 protracts through the aperture 36, 37 or the locking portion 79 extends into the aperture 36, the arm 30 may be engaged with the face 24 of any number of drawers 22, thereby locking the arm 30 into engagement with the face 24 of the drawer(s) 22, positioning the arm 30 in a locked position P1. Notably, when the arm 30 is in a locked position P1, the drawer(s) 22 are recessed within the enclosure 12 in a locked position as well. When recessed, the locked position of the drawer(s) 22 provide the additional security of not allowing a pry bar or some other leverage to be positioned behind the face 24 of the drawer(s) 22, thereby further preventing any unwanted person from accessing the drawer's contents, such as firearms 1.

In some embodiments, as depicted in FIGS. 10 and 11, for example, the arm(s) 30 may further define an opposite horizontal portion 85 extending between the gripping plane 75 and the pivoting plane 74 on the lowermost edges of the arm 30. Further, the arm(s) 30 may define an opposite vertical portion 86 extending perpendicularly from the horizontal portion 85 for engaging the bottom side 16 of the enclosure 12 when the arm 30 is in the locked position P1.

In addition to the locked position P1, the arm(s) 30 may be in an unlocked position P2. In some embodiments, the arm(s) 30 may be released from the locked position P1 through the manipulation of a lever 44 positioned proximal to the aperture 36. The lever 44 may translate the latch 34 to retract within the receptacle 32 in one embodiment or may retract a latch 34 from extension through a locking aperture 37 according to another embodiment. When the latch 34 retracts, the arm 30 is permitted to disengage from the face 24 of the drawer 22, rotate away from the face 24, and be placed in an unlocked position P2. In the unlocked position P2, according to one embodiment, the latch 34 may again protract or extend out from the receptacle 32 of the arm 30, but will not protract through an aperture 36 of the enclosure 12.

The lever 44 may be any number of unlocking shapes and sizes. Several embodiments are depicted in FIGS. 12 and 13, where the lever 44 is shaped similar to a boomerang, with a convex side and a concave arcuate side meeting at their two ends. A central point of the boomerang lever 44A may be pivotedly secured to the enclosure 12. In a locked position P1, the boomerang lever 44A defines a central surface of the convex side for engaging the latch 34. When the boomerang lever 44A is rotated, the point at which the concave and convex sides meet is rotated towards and into proximal position to the latch 34, thereby moving the latch 34 back into the receptacle 32 and permitting the arm 30 to be disengaged from the enclosure 12 (through disengagement of the latch 34 from the aperture 36) and pivoted into an unlocked position P2.

In at least another embodiment, a threaded gear lever 44B is provided. The threaded gear lever 44B may generally be cylindrically shaped with threads covering an upper portion. By rotating the threaded gear lever 44B via the threads, the lever 44B is repositioned along a vertical axis, for retracting the latch 34 and permitting the latch 34 protract. In yet another embodiment, a slotted (or serrated) gear lever 44C is provided. Like the boomerang lever 44A, the slotted gear lever 44C may be pivotedly secured to the enclosure 12 about a central point. Rotation of the slotted gear lever 44C, through selective engagement and repositioning of the slots, retracts the latch 34 and permits the latch 34 to protract, as the edge of the lever 44C is shaped to engage the latch 34 at different heights.

Figure 14:
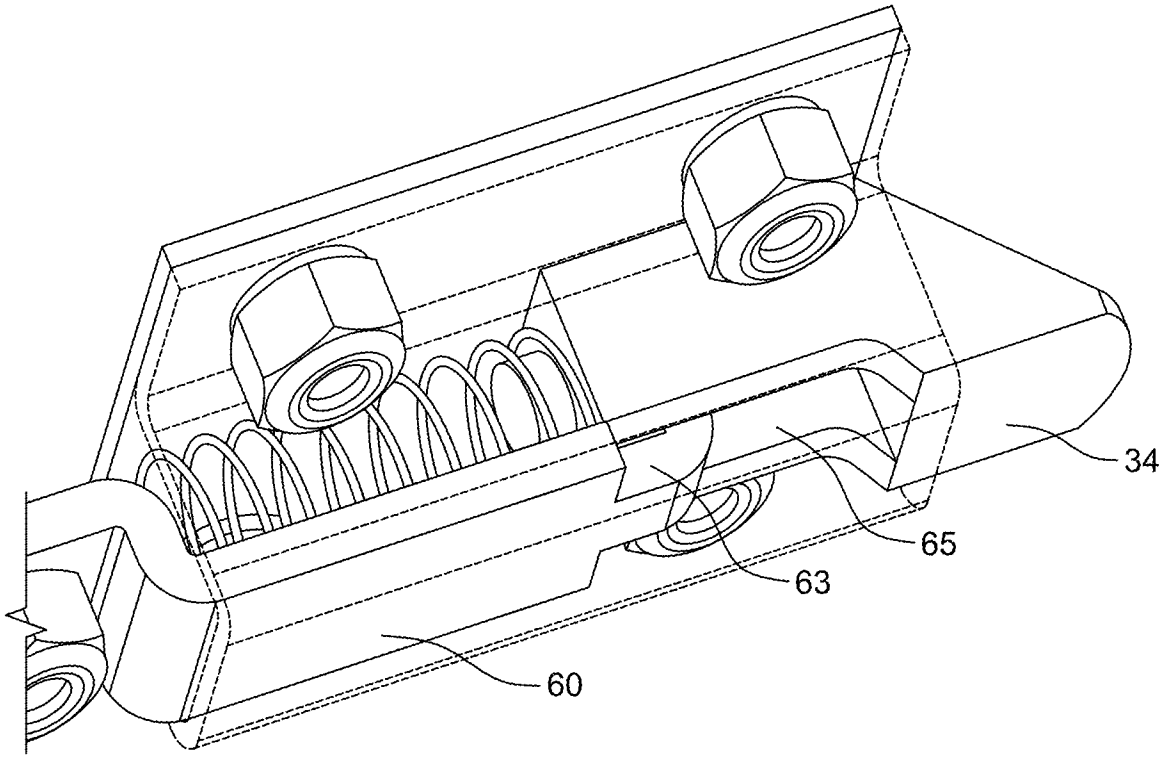
FIG. 14 illustrates a view of a latch and rod according to one or more embodiments disclosed herein.
Figure 15:
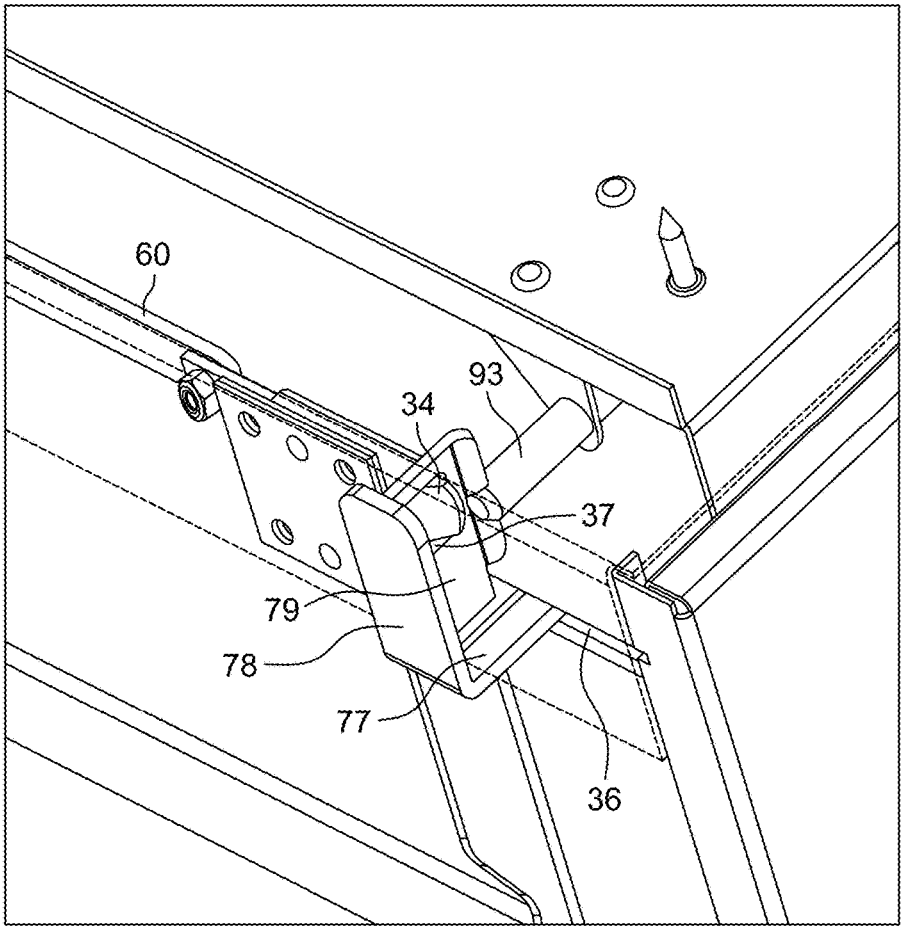
FIG. 15 illustrates a view of the arm in the locked position using a latch and locking aperture according to one or more embodiments disclosed herein.

In yet another embodiment, a latch 34 may be included as part of a modified bolt latch, as depicted in FIG. 14. The latch 34 may be angled to receive the locking configuration 76, such that the locking portion 79, when pivoting into the locked position P1 and entering the enclosure aperture 36, may translate the latch 34 against the spring of the bolt latch until the spring force successfully translates the latch 34 through the locking aperture 37, securing the arm 30 into the locked position P1, as is depicted in FIG. 15.

Figure 16:
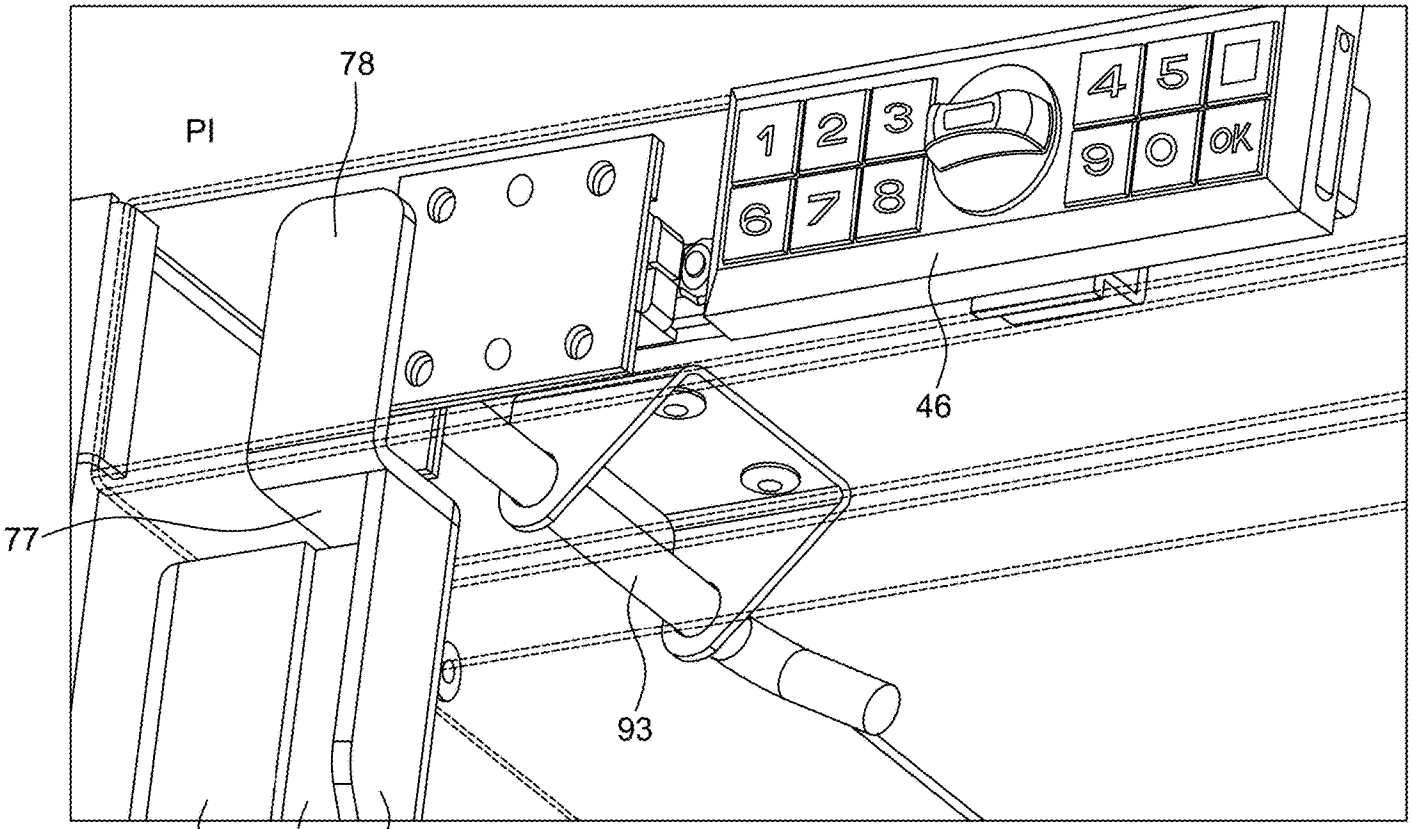
FIG. 16 illustrates a view of a spring pin engaging the arm when in the locked position according to one or more embodiments disclosed herein.

FIG. 16 depicts a spring pin 93 positioned within the enclosure 12 for engaging the arm 30 when in the locked position P1. When the latch 34 is translated, and the arm 30 is released from the locked position P1, the spring pin 93 forces the arm 30 to pivot away from the enclosure 12. In this manner, the arms 30 may translate away from the enclosure 12 immediately upon release from the locked position P1 so that the drawers 22, 26 may be translated immediately for use. In some embodiments, the spring pin 93 may be engaged with the locking portion 79 when the arm 30 is in the locked position P1, the locking portion 79 being a plane. In other embodiments, other properties of the enclosure 12 or system 10 may permit the arm(s) 30 to swing open upon disengagement from the latch 34 and the arm 30. For example, in embodiments including water-resistant materials 54 being compressed when the arm 30 is in the locked position P1, the disengagement of the latch 34 from the arm 30, and/or the locking aperture 37, would permit the water-resistant materials 54 to decompress, thereby applying pressure to the arm 30 and assisting the arm 30 in swinging away from the open side 20 of the enclosure 12. In other embodiments, the piano hinge or engagement between the pivoting plane 74 and the engaging plane 73 may be biased to swing the arm 30 away from the open side 20 of the enclosure 12. A piano hinge, for example, may be angled downward and away from the open side 20 of the enclosure where the pivoting plane 20 and engaging plane 73 meet each other.

Figure 17:
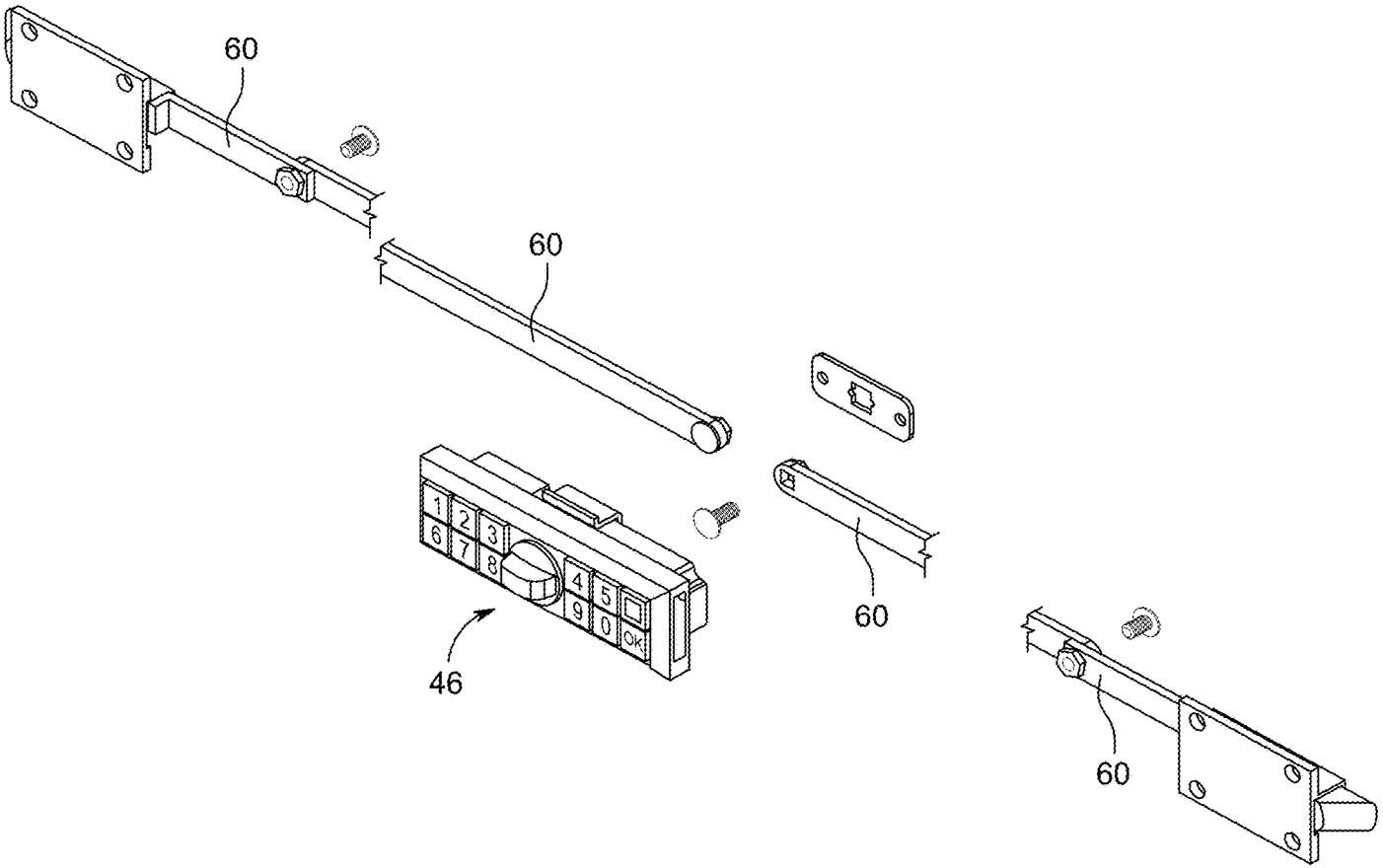
FIG. 17 illustrates a perspective view of a switch and a rod operating a latch according to one or more embodiments disclosed herein.
Figure 18:
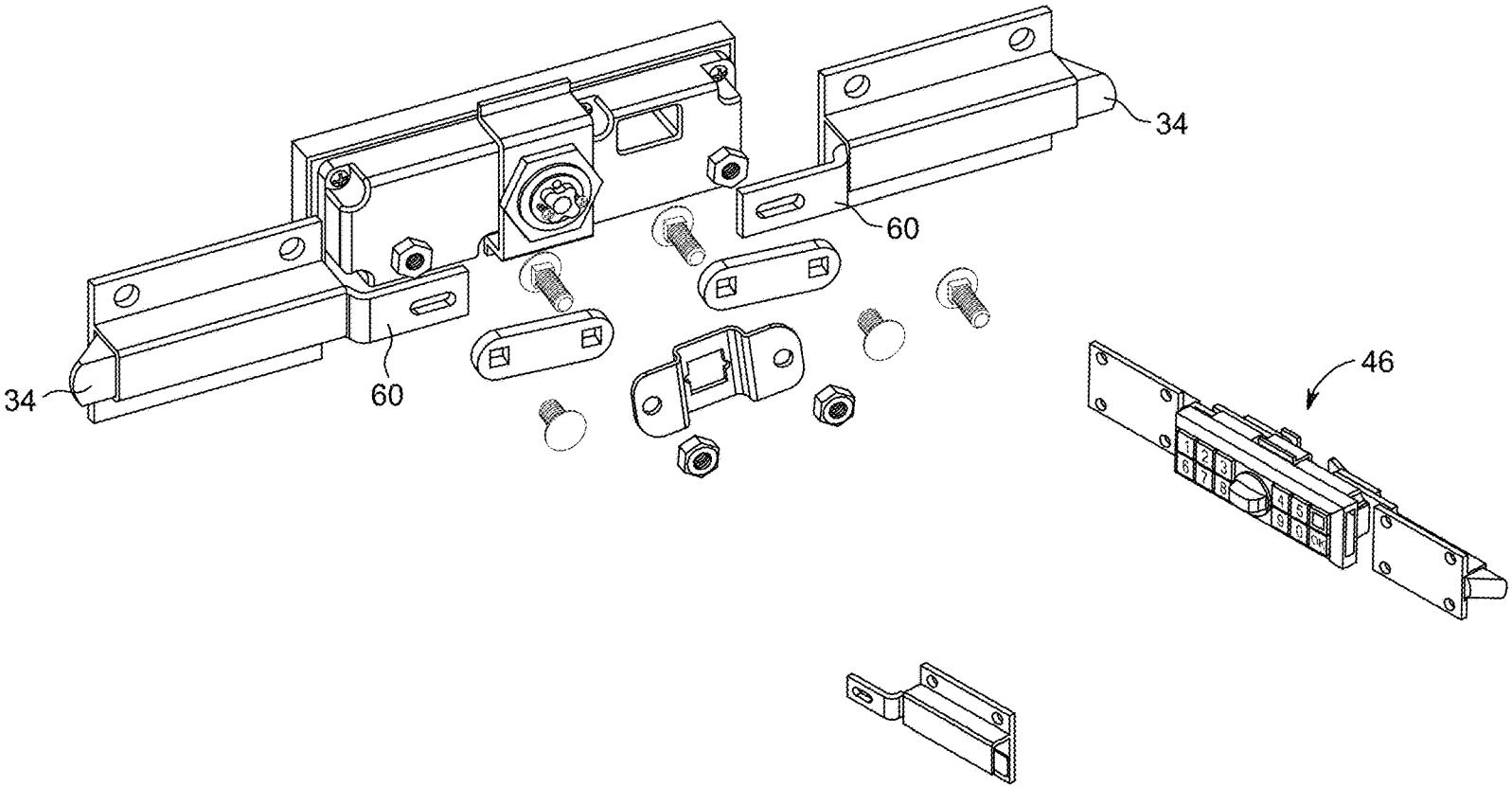
FIG. 18 illustrates an exploded view of a switch and a rod operating a latch according to one or more embodiments disclosed herein.

The movement of the lever 44, whether it be a boomerang lever 44A, a threaded gear lever 44B, a slotted gear lever 44C or any other type of suitable lever 44, may be controlled by a switch 46. As is depicted in FIGS. 17 and 18, the switch 46 may be engaged with the lever 44 for controlling the movement thereof. The switch 46 may include a key, a keyhole 40, and a rod 60 engaged with the lever 44. In other embodiments, the switch 46 may include a fingerprint scanner, digital keypad, or some other digital lock (e.g., near field communication device, eye reader, voice activated reader, etc.). In at least another embodiment, the switch 46 may include a dial lock or some other type of mechanical lock. Any switch 46 may be engaged with a rod 60 for rotating the lever 44 or translating the latch 34. For example, engaging and rotating the proper key within a keyhole 40 may cause translation of the rod(s) 60, which may, in turn pivot or rotate the lever 44 (or translate the latch 34) upon translatable interaction therewith. In other embodiments of the storage system 10, a lever 44 and/or a lever system 45 and/or latch 34 may be housed within the right side and/or left side of the enclosure 12.

In some embodiments, the rod 60 may extend along the width of the open side 20 of the enclosure 12. For example, the rod 60 may extend from a switch 46 positioned in the center of the top side of the enclosure 12 and facing outward from the open side 20 to the lever 44 positioned proximal the vertical partition 50Y and onward to a lever 44 positioned proximal to the left or right side of the enclosure 12. The lever 44 may be part of a lever system 45, and the lever system 45 may include one or more stabilizing arms for aiding in the precise and controlled movement of the rod 60. Further, the rod 60 may define a lever tab 61 for aiding in the pivoting rotation of the lever 44. For example, the lever 44 may define a cavity 47 for accepting the lever tab 61 for controlled and precise rotation of the lever 44 through movement of the rod 60.

In alternative embodiments, as is depicted in FIGS. 14-18, the rod 60 may be engaged with a spring-based latch 34. The rod 60 may define a rod hook 63 engaged with a latch groove 65 for translating the latch 34 without the locking aperture 37. The latch 34 may be coupled or engaged with a spring biased to translate the latch 34 through the locking aperture 37 of the locking portion 79. Successful activation of the switch 46 may translate the rod 60 away from the corresponding locking portion 79, thereby translating the rod hook 63, latch groove 65 and latch 34 away from the corresponding locking portion 79, permitting pivoting of the corresponding arm 30 from the locked position P1.

Figure 19:
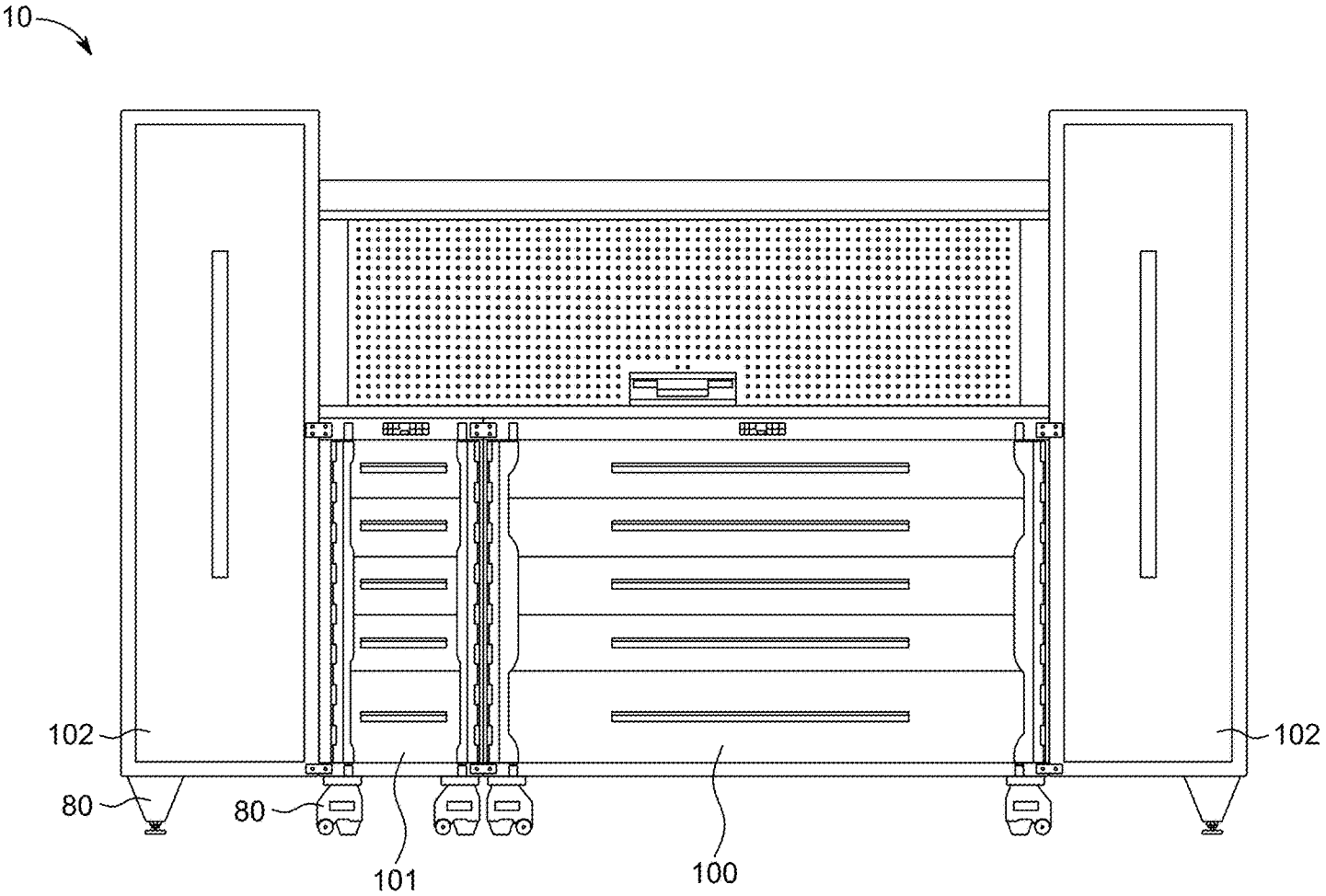
FIG. 19 illustrates a front view of the system including several enclosures according to one or more embodiments disclosed herein.
Figure 20:
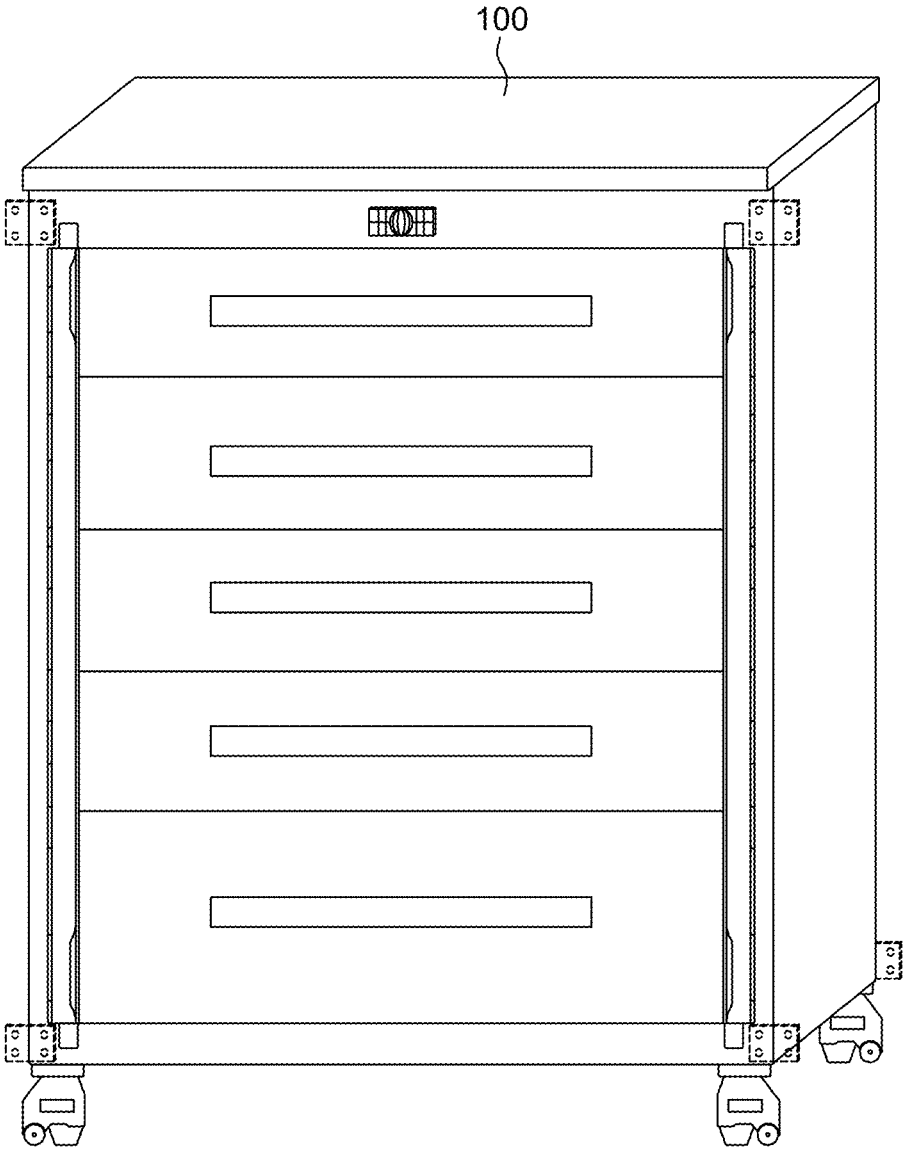
FIG. 20 illustrates a perspective view of a drawer enclosure according to one or more embodiments disclosed herein.
Figure 21:
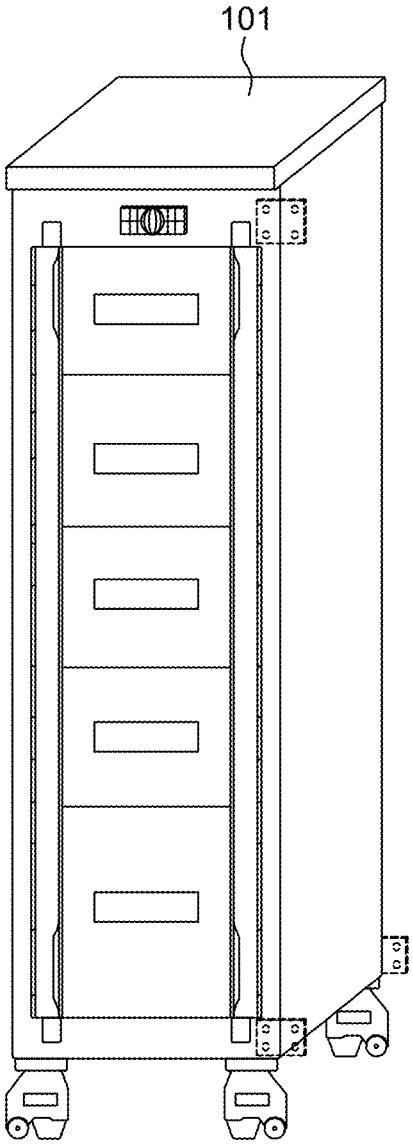
FIG. 21 illustrates a perspective view of an additional drawer enclosure including several enclosures according to one or more embodiments disclosed herein.
Figure 22:
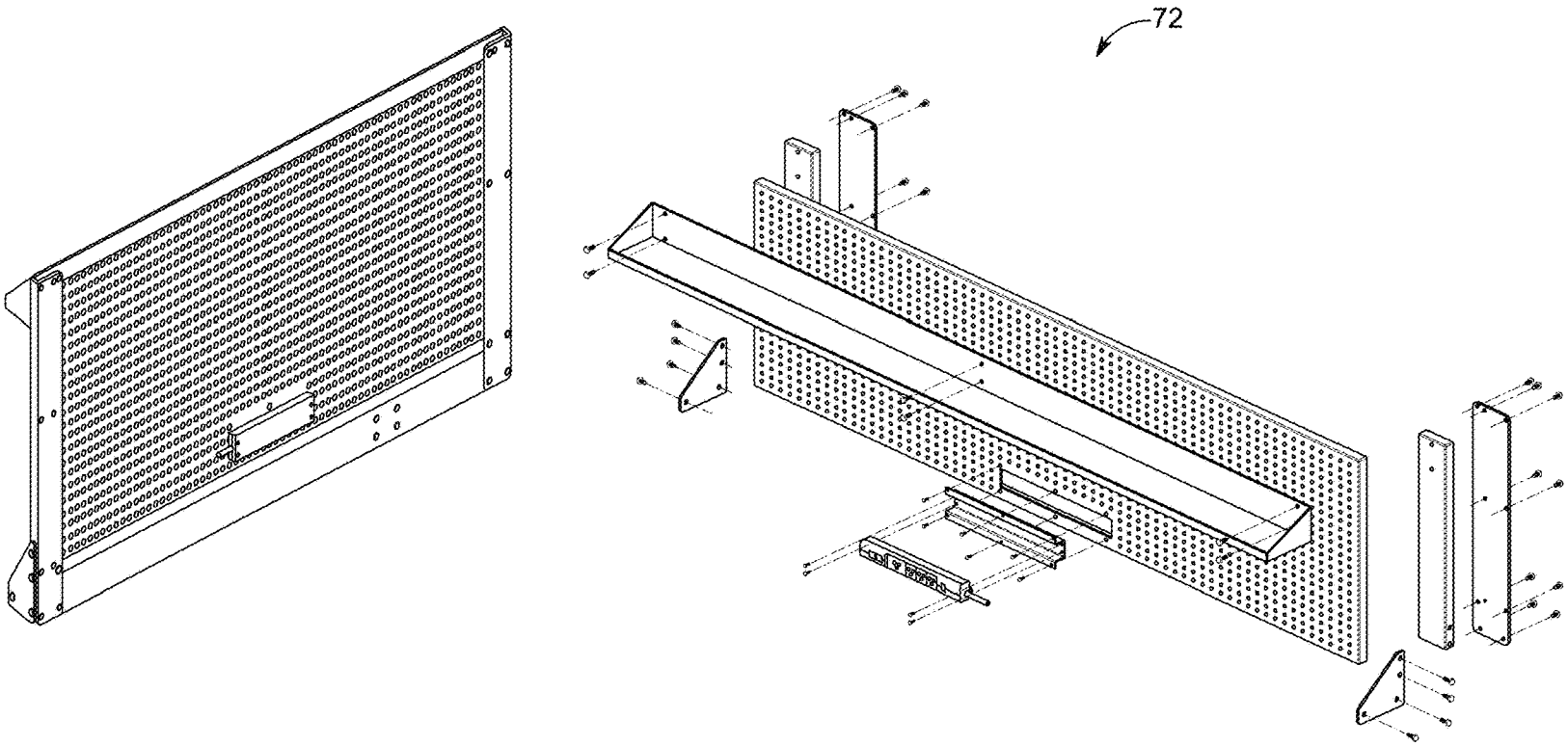
FIG. 22 illustrates an exploded view of the backboard according to one or more embodiments disclosed herein.

As depicted in FIGS. 19-24 the system 10 may include a number of selectively coupled enclosures 12, 100-102. The enclosures 12, 100-102 may be positioned adjacent to each other and/or may be selectively coupled to each other using one or more enclosure attachments 104. The enclosure attachments may be positioned across the front-facing and/or back-facing sides of two adjacent enclosures 12, 100-102. As depicted in FIG. 19, numerous enclosures 12, 100-102 having several enclosure attachments 104 may be included in the system 10. An enclosure 100 for a column of drawers 22 is depicted in FIG. 20. A additional enclosure 101 for a column of additional drawers 26 is depicted in FIG. 21. A backboard 72 configured for extending above and across both the enclosure 100 and the additional enclosure 101, when adjacently positioned and/or selectively coupled, is depicted.

Figure 23:
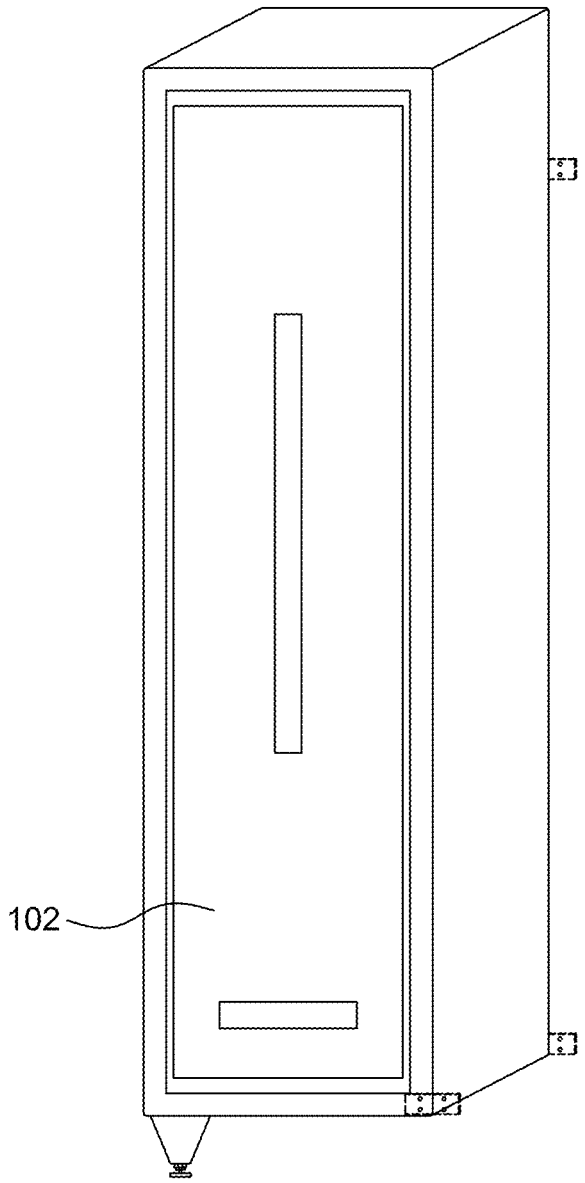
FIG. 23 illustrates a perspective view of a cabinet enclosure according to one or more embodiments disclosed herein.
Figure 24:
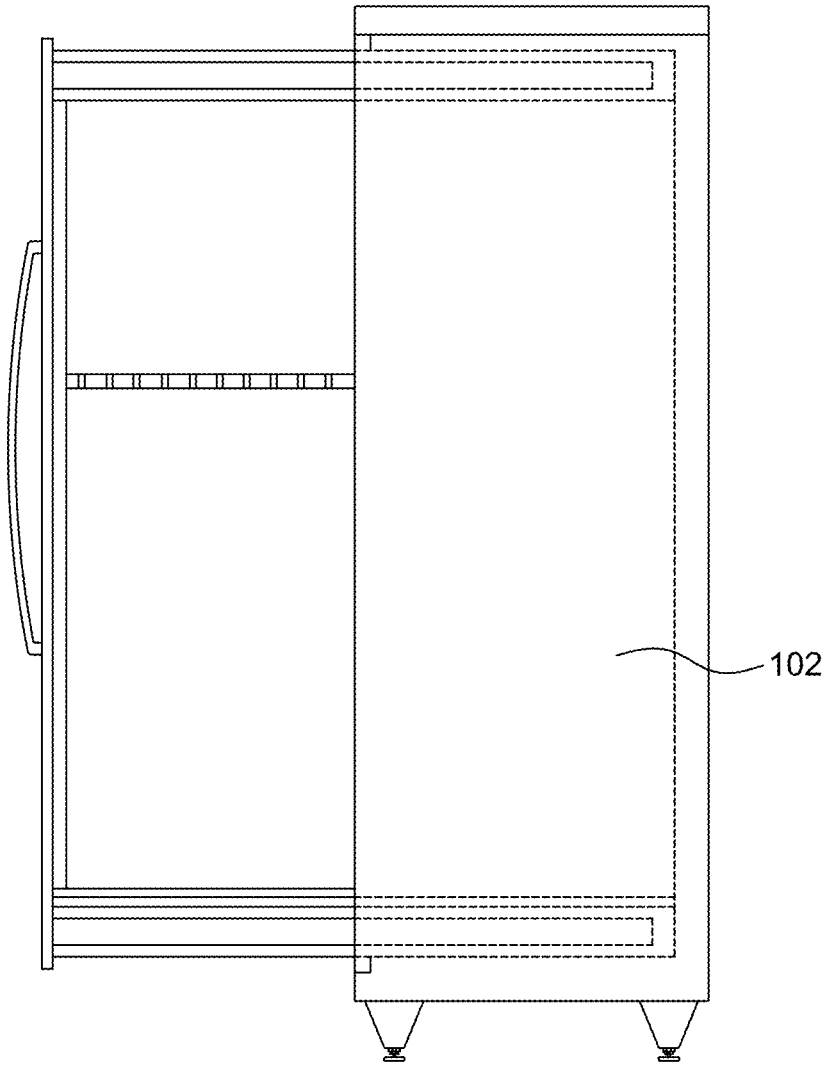
FIG. 24 illustrates a side view of an open cabinet enclosure according to one or more embodiments disclosed herein.

FIGS. 23 and 24 depict embodiments of a cabinet enclosure 102. The drawer 22 of the cabinet enclosure 102 may include any of the features described herein. The handle 64 may be vertically aligned. The cabinet enclosure 102 may be equipped with two, four or any number of supports 80. In some embodiments, the cabinet enclosure 102 may only include two supports 80 positioned under the side distal from the adjacent enclosure 12, 100, 101 selectively coupled to the opposite side of the cabinet enclosure 102. The drawer 22 of the cabinet enclosure 102 may have an interior 25 defined by a side, a bottom, a back and a front (e.g., face 24), leaving an opposite side open, either partially or fully, as depicted in FIG. 24. The drawer 22 may further include a top. A gun rack 105 may be positioned horizontally on the side of the interior 25 of the drawer 22 for accepting long guns thereon or therewithin. Lights, such as LED lights, may be positioned on the top or underneath a drawer slide 23 for lighting the interior 25 of the drawer 22. The drawer 22 may include at least four slides 23, two positioned on the side and two positioned on the opposite side and/or the edge of the top and bottom sides.

The cabinet enclosure 102, or any other enclosure 12, 100, 101, may include one or two arms 30 positioned vertically for locking the drawers 22, 26 and/or may include one or two arms 30 positioned horizontally for locking the drawers 22, 26 using any of the arm-locking configurations described herein.

In some embodiments, a single switch 46 is provided for a column of drawers 22 and a column of additional drawers 26. In other embodiments, individual switches 26 are provided for each column of drawers 22 and additional drawers 26. In embodiments of the system 10 including selectively coupled enclosures 12, 101-102, each enclosure may include its own switch 26.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

The invention claimed is:

1. A storage system comprising:

a cuboid-shaped enclosure including a front opening, a top wall, a bottom wall, a left wall, a right wall, a back wall, and an interior defined between the walls;

a drawer in translating engagement with the interior;

an arm secured to the enclosure and configured to pivot within the opening into a locked position and without the opening in an unlocked position, wherein the drawer is fully positioned in the interior and defines a face positioned in the opening when the arm is in the locked position, and wherein the drawer is translatable through the opening when the arm is in the unlocked position;

a locking plane extending from the arm and defining a locking aperture therethrough, wherein when the arm is in the locked position the locking plane extends through an enclosure aperture defined wholly by the top wall; and a latch wholly positioned within the top wall and translatable through the locking aperture of the arm for locking the arm in the locked position.

2. The storage system of claim 1, further comprising a switch engaged with a rod for controlling the translation of the latch.

3. The storage system of claim 2, wherein the switch includes a keyhole, a keypad and/or a fingerprint scanner.

4. The storage system of claim 1, wherein the face of the drawer includes fire-resistant materials therein.

5. The storage system of claim 4, wherein the walls include the fire-resistant materials therein.

6. The storage system of claim 1, further comprising a water-resistant layer positioned between the interior of the enclosure and an interior-facing side of the face of the drawer for being compressed and forming a water-resistant seal when the arm is in a locked position.

7. The storage system of claim 1, wherein the arm extends at least across an entire height of the face of the drawer, the arm defining an engaging portion coupled to the enclosure and a pivoting portion pivotally coupled to the engaging portion and engageable with the face of the drawer.

8. The storage system of claim 1, further comprising:

a top layer secured to the top wall for providing a work surface;

a backboard extending upwards from the back wall; and supports coupled to the bottom wall for elevating the enclosure above a surface on which the enclosure rests or moves.

9. The storage system of claim 1, further comprising:

a second arm secured to the enclosure and configured to pivot within the open side into a locked position and without the open side in an unlocked position, the second arm parallel to the arm and positioned on an opposite side of the drawer relative to the arm;

a second translatable latch positioned within the enclosure and engageable with a second locking aperture of the second arm for locking the second arm.

10. The storage system of claim 1, further comprising:

a partition bisecting the open side and the interior, wherein the drawer is positioned on one side of the partition and an additional drawer having an additional face is positioned on the other side of the partition, the additional drawer in translating engagement with the interior of the enclosure, including the partition;

a third arm secured to the enclosure and configured to pivot within the open side of the other side of the partition into a locked position and without the open side of the other side of the partition in an unlocked position, wherein the additional drawer is fully positioned in the interior when the third arm is in the locked position, and wherein the drawer is translatable through the open side when the third arm is in the unlocked position; and a third translatable latch positioned within the enclosure and engageable with a third locking aperture of the third arm for locking the third arm in the locked position.

11. The storage system of claim 10, further comprising:

a second arm secured to the enclosure and configured to pivot within the open side of the one side of the partition into a locked position and without the open side of the one side of the partition in an unlocked position, the second arm parallel to the arm and positioned on an opposite side of the drawer relative to the arm;

a second translatable latch positioned within the enclosure and engageable with a second locking aperture of the second arm for locking the second arm.

12. The storage system of claim 11, further comprising:

a fourth arm secured to the enclosure and configured to pivot within the open side of the other side of the partition into a locked position and without the open side of the other side of the partition in an unlocked position, the fourth arm parallel to the third arm and positioned on an opposite side of the additional drawer relative to the third arm;

a fourth translatable latch positioned within the enclosure and engageable with a fourth locking aperture of the fourth arm for locking the fourth arm.

13. The storage system of claim 1, further comprising:

a cuboid-shaped additional enclosure including an additional front opening, an additional top wall, an additional bottom wall, an additional left wall, an additional right wall, an additional back wall, and an additional interior defined between the additional walls, one of the additional left or right walls selectively coupled to one of the left or right walls of the enclosure;

an additional drawer in translating engagement with the additional interior of the additional enclosure;

a third arm secured to the additional enclosure and configured to pivot within the additional opening into a locked position and without the additional opening in an unlocked position, wherein the additional drawer is fully positioned in the additional interior and defines an additional face positioned in the additional opening when the third arm is in the locked position, and wherein the additional drawer is translatable through the additional opening when the third arm is in the unlocked position; and an additional translatable latch positioned within the additional enclosure and engageable with an additional locking aperture of the third arm for locking the third arm in the locked position.

14. The storage system of claim 13, further including a backboard extending upwards from the back wall and the additional back wall.

15. The storage system of claim 13, further including vertical enclosures selectively coupled to the enclosure or additional enclosure for providing additional storage.

16. The storage system of claim 1, further comprising a spring pin positioned within the enclosure for engaging the locking plane and applying a rotational bias to the arm when the arm is in the locked position.

17. The storage system of claim 1, wherein the latch is horizontally translatable for extending through the locking aperture of the arm for locking the arm in the locked position.

* * * * *